US006735415B2

(12) United States Patent
Isobe et al.

(10) Patent No.: US 6,735,415 B2
(45) Date of Patent: May 11, 2004

(54) SHEET POSTPROCESSING APPARATUS AND IMAGE FORMING APPARATUS

(75) Inventors: Kenichiro Isobe, Shizuoka-ken (JP); Yasuyoshi Hayakawa, Shizuoka-ken (JP); Takashi Kuwata, Shizuoka-ken (JP); Masayoshi Fukatsu, Shizuoka-ken (JP); Junichi Sekiyama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/372,776

(22) Filed: Feb. 26, 2003

(65) Prior Publication Data

US 2003/0161669 A1 Aug. 28, 2003

(30) Foreign Application Priority Data

Feb. 28, 2002 (JP) ..... 2002-053053
Feb. 10, 2003 (JP) ..... 2003-032171

(51) Int. Cl.[7] ..... B65H 37/04; G03G 15/00

(52) U.S. Cl. ..... 399/410; 270/58.08; 399/110; 399/407

(58) Field of Search ..... 399/410, 408, 399/407, 110, 107, 21; 270/37, 58.08

(56) References Cited

U.S. PATENT DOCUMENTS 6,341,772 B1 1/2002 Waragai et al. ..... 270/58.08
2003/0044209 A1 * 3/2003 Isobe et al. ..... 399/410

FOREIGN PATENT DOCUMENTS

JP 09-183560 * 7/1997
JP 2001-010764 * 1/2001
JP 2001-302080 * 10/2001

* cited by examiner

*Primary Examiner*—Sophia S. Chen
(74) *Attorney, Agent, or Firm*—Fitzpatrick, Cella, Harper & Scinto

(57) ABSTRACT

The present invention relates to a sheet processing apparatus having a stapling means disposed detachably for stapling to conveyed sheets, the stapling means being movably supported between an operation position for stapling conveyed sheets and a replacement position for detaching the stapling means from the apparatus, the stapling means comprising; a connection portion connected to the apparatus for receiving a control signal from the apparatus; a cable for transmitting the control signal from the connection portion to the stapling means; and an urging means for urging the cable toward the inner side of the stapling means.

24 Claims, 21 Drawing Sheets

SHEET POSTPROCESSING APPARATUS AND IMAGE FORMING APPARATUS

BACKGROUND OF THE INVENTION

1. Field of the Invention

This invention relates to a sheet processing apparatus and an image forming apparatus having the sheet processing apparatus and, more particularly, to a sheet processing apparatus avoiding occurrence of clamping wires for a staple holder and an image forming apparatus having the sheet processing apparatus.

2. Description of Related Art

Image forming apparatuses such as printers may conventionally have a sheet processing apparatus in which plural sheets on which images are formed or printed are subject to a processing such as stapling upon aligning each end properly to perform such a processing on the sheets to be delivered. As such a sheet processing apparatus, a known type disposed on a side surface on a sheet delivery outlet of an image forming apparatus, has a structure that sheets printed in the image forming apparatus are fed sheet by sheet from the delivery outlet and aligned at the each end to deliver the sheets upon processing.

A stapling mechanism section is generally disposed inside the housing of the sheet postprocessing apparatus. A widely known type has a structure that a housing lid is opened to handle paper jamming at the stapling mechanism section in the apparatus interior, to replace staples, and to replace the staple mechanism section, at times of occurrences of paper jamming at the stapling section, replacements of stapling, and malfunctions of the stapling mechanism section.

With these sheet processing apparatuses having such a stapling function, however, users have to laboriously open the housing lid to handle paper jamming or staple replacement through the stapling mechanism section located at the interior of the apparatus when paper jamming occurs or staple replacement is required at the staple section because the staple mechanism section is disposed at the inner side of the housing of the sheet processing apparatus. The users therefore have to go through a large number of actions during handling of paper jamming or staple replacement, and are subject to bad maneuverability as processing on the internal apparatus located inside the housing. These apparatuses also have disadvantages such that the apparatuses become structurally complicated as the apparatus housing is formed with the lid and thereby increase the costs.

A structure has been recently devised in which users can handle unit replacement properly during paper jamming processing, staple replacement or malfunction of the stapling section upon moving the unit directly in the accessing direction, where a housing of a unit of the staple mechanism section also serves as the outer housing of the sheet processing apparatus, and where the unit is movable and detachable from the sheet processing apparatus.

With such a structure, however, the staple unit or stapler requires a detachable connector cable where the power source of the stapler is supplied from the side of the sheet processing apparatus. The connector cable is prepared to have a longer length than the necessary length in consideration of handling easiness, but the cable may be clamped between the housing of the staple holder and the apparatus body when the staple holder is moved, attached or detached, or namely, so-called "wire clamping" may occur.

SUMMARY OF THE INVENTION

It is an object of the invention to prevent lime clamping of the cable for a staple holder. To accomplish the above object, a representative structure of the invention is of a sheet processing apparatus having a stapling means disposed detachably for stapling to conveyed sheets. The stapling means takes an operation position for stapling processing to a conveyed sheet and a replacement position for detaching the stapling means from the apparatus. The stapling means includes a connection portion connected to the apparatus for receiving a control signal from the apparatus, a cable for transmitting the control signal from the connection portion to the stapling means, and an urging means for urging the cable toward the inner side of the stapling means.

With this invention, thus, the stapling means has the urging means for urging the cable toward the inner side of the stapling means, and therefore, the cable of the stapling means is pulled inside the stapling means, so that wire clamping in which the cable is clamped between the stapling means and the apparatus is avoided.

DETAILED DESCRIPTION OF THE PREFERRED EMBODIMENTS

Figure 1:
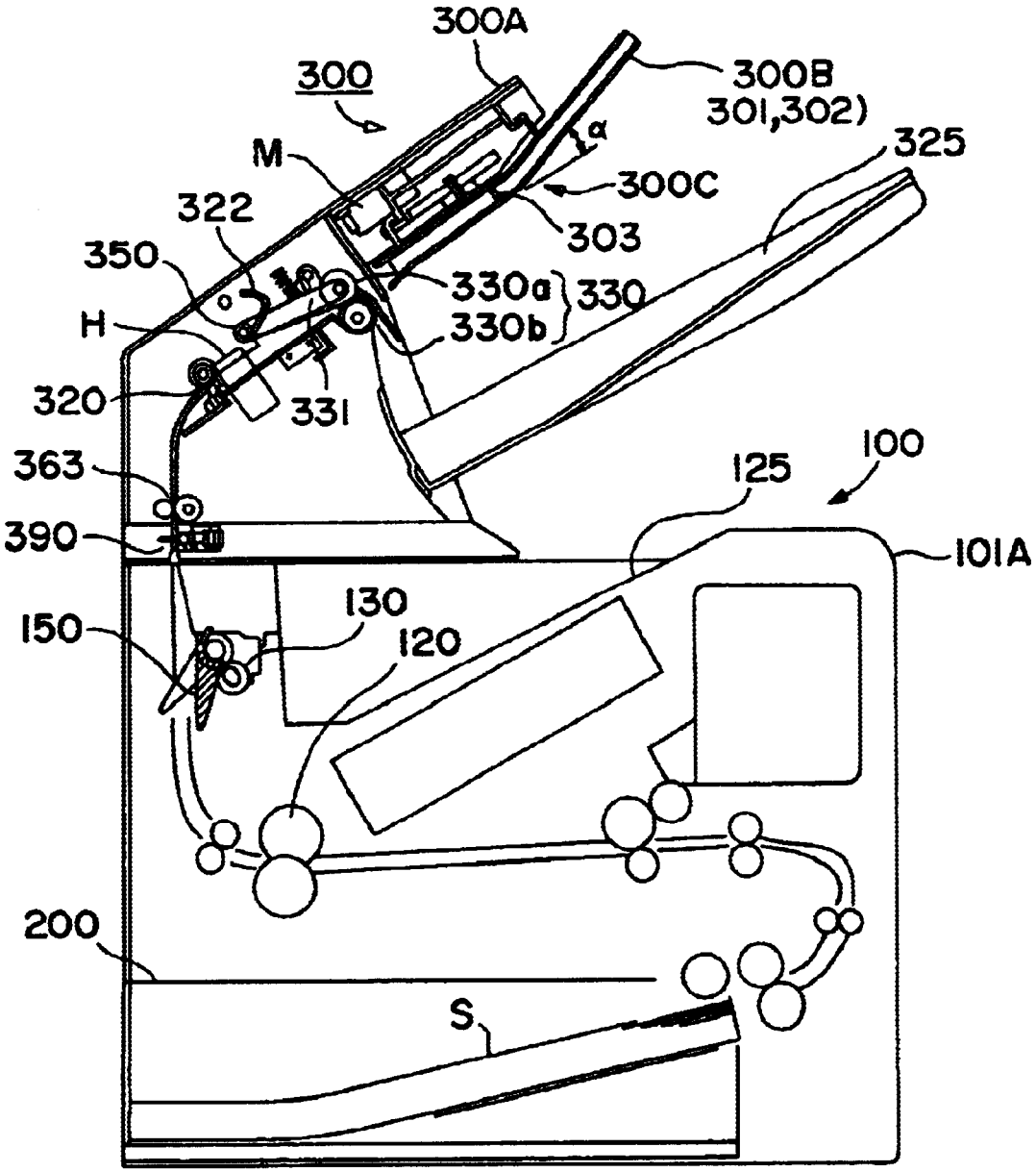
FIG. 1 is a schematic cross section showing the whole structure of a sheet processing apparatus and an image forming apparatus.

Referring to the drawings, the embodiments of the invention are described in detail. In the following embodiments, exemplified is a sheet processing apparatus mounted to a printer apparatus as represented by a laser beam printer.

First Embodiment

First, referring to FIG. 1 to FIG. 6, structures of a printer body and a sheet processing apparatus, a series of operations in the first embodiment are described. FIG. 1 is a schematic cross section showing the whole structure of a sheet processing apparatus and an image forming apparatus.

In FIG. 1, numeral 100 indicates a printer body, which is solely coupled to a computer or coupled to a network such as a LAN or the like, and which forms images on sheets with a prescribed image forming process based on image information transmitted from the computer or the network and a print signal and delivers the printed sheets.

In a meantime, the sheet processing apparatus 300 is an apparatus that stacks, on a first sheet stacking portion, sheets delivered from the printer 100 to the exterior thereof via a conveyance portion in the sheet processing apparatus as facing down state in which the image side is placed downward, aligns the sheets with the aligning means, and delivers on the stacking portion 325 of the sheet processing apparatus the stacked sheets upon stapling the sheets at a single or plural portions of the sheets where the sheets are bundled at each prescribed job, or delivers sheets as facing down on the stacking portion 325 of the sheet processing apparatus.

The sheet processing apparatus 300 and the printer body 100 are electrically coupled with a cable connector not shown. The sheet processing apparatus 300 has a housing 300A for containing each part and is detachably attached to an apparatus body 100A of the printer body 100 as described below.

Each structure of portions of the printer body 100 is described along the conveyance path at of the sheet S to be conveyed. In the printer 100, plural sheets S are stacked in a feeding cassette 200, and various rollers separately conveys the topmost sheet one by one among the plural sheets. According to a prescribed printer signal fed from the computer or the network, toner images are transferred to the sheets S fed from the feeding cassette 200 on a top side of the sheets at an image forming section 101 for forming toner images by an image forming process of a so-called laser beam type in the printer body 100, and subsequently, are permanently fixed upon application of heat and pressure at a fixing unit 120 located on a downstream side.

The sheet S to which images are fixed is turned to reverse the image side by being returned through a sheet conveyance path curving in a substantially letter U shape reaching to delivery rollers 130 as shown in FIG. 1, and is delivered as facing down to the exterior from the printer body 100 by the delivery roller 130 in a state that the image side faces down. The sheet S is selected to be delivered either to a face-down (FD) delivery portion 125 mounted on a top of the printer body 100 or to the stacking portion 325 of the sheet processing apparatus 300 according to the determination of the position of a flapper 150 in the printer 100 based on the control signal from the controller, not shown.

Figure 2A:
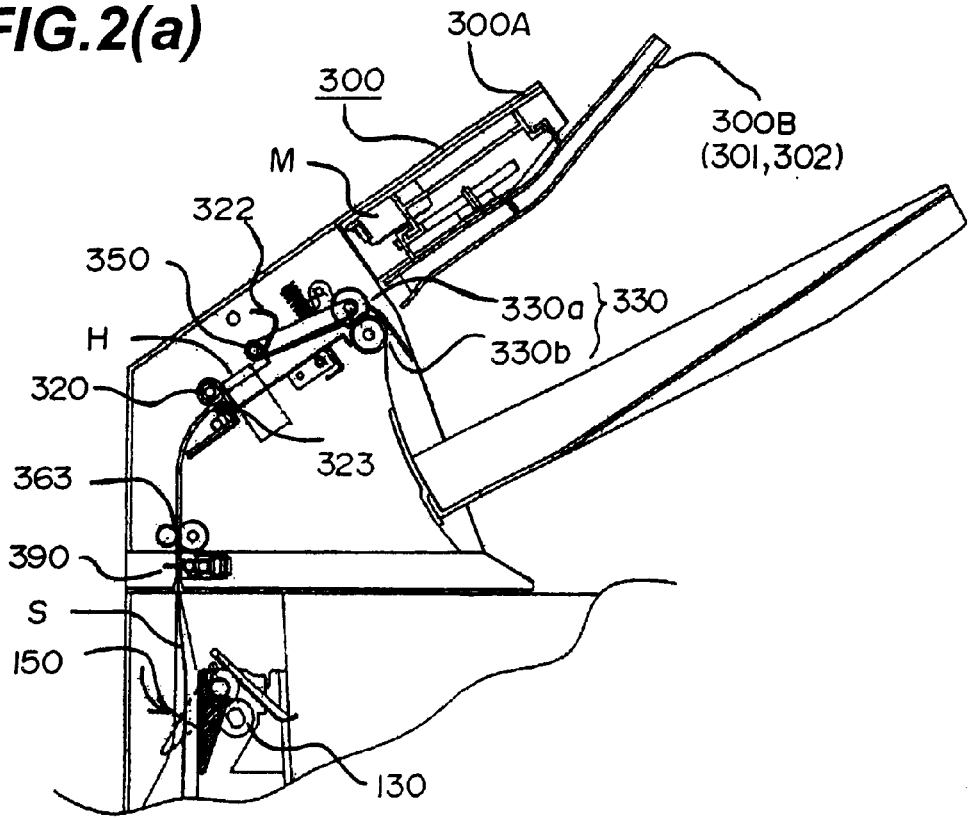
FIG. 2 collectively includes FIGS. 2(*a*) and 2(*b*), which are cross sections showing a delivery roller and the sheet processing apparatus.
Figure 2B:
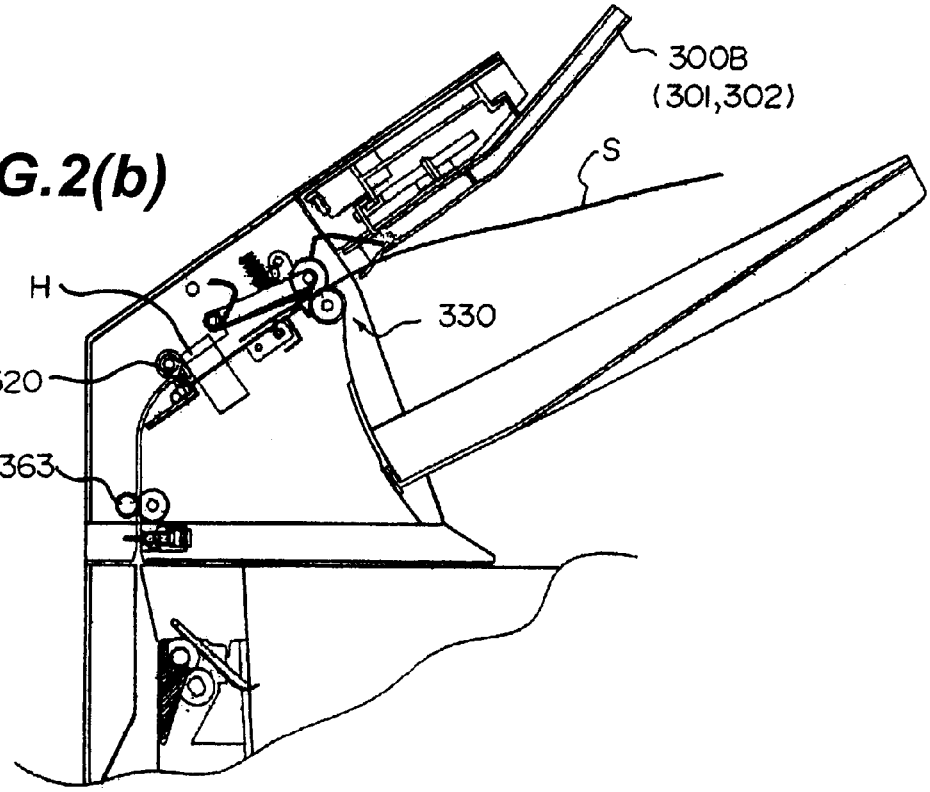
Figures 3A, 3B:
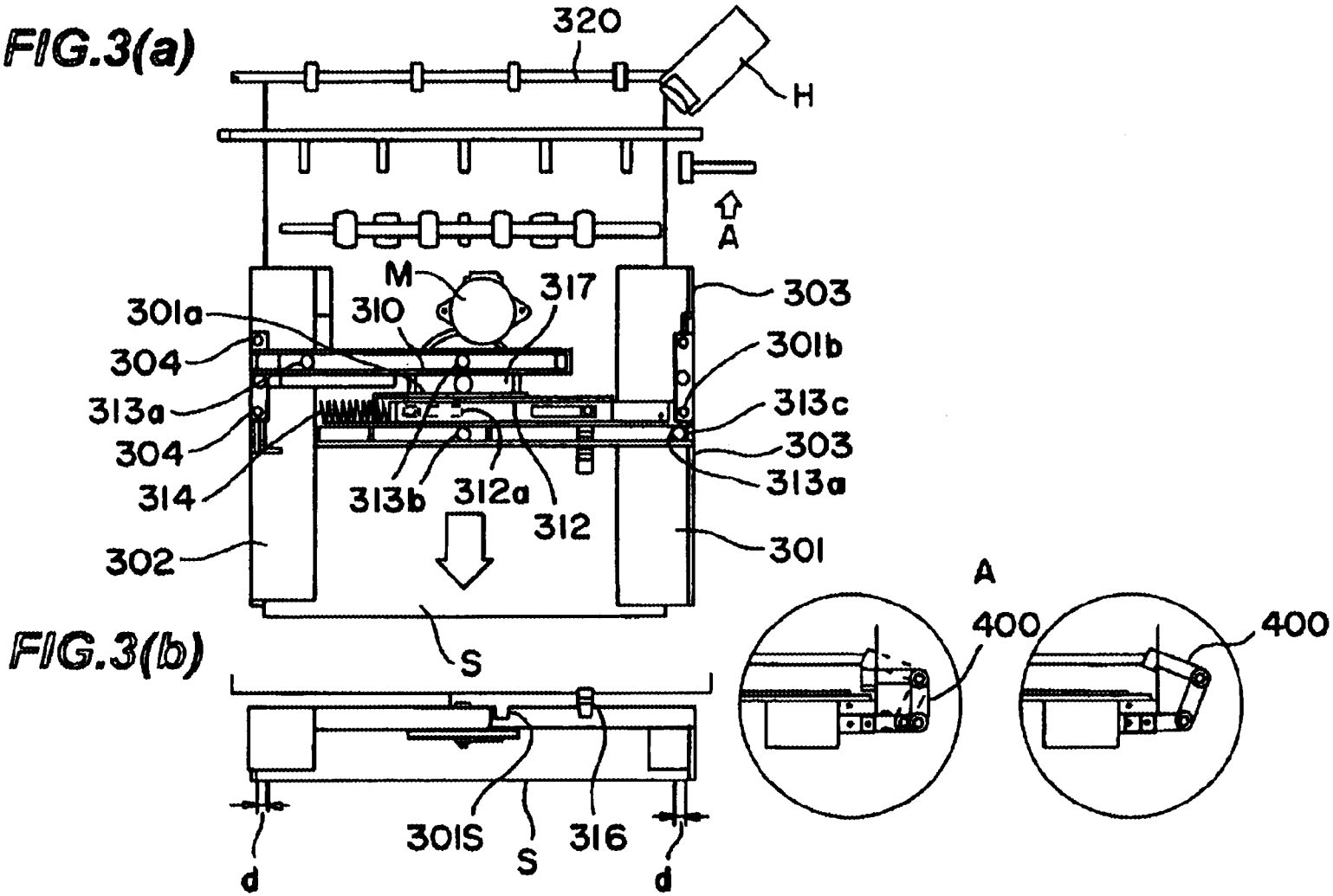
FIG. 3 collectively includes FIGS. 3(*a*) and 3(*b*), which are cross sections showing a sheet process apparatus.

Then, the structure of the sheet processing apparatus, and motions of the respective portions when the sheet conveyed from the delivery roller 130 moves toward the sheet processing apparatus 300, are described in reference with FIG. 2 and FIG. 3. Herein, FIGS. 2(*a*) and 2(*b*) are cross sections of the delivery roller and the sheet processing apparatus; FIGS. 3(*a*) and 3(*b*) are cross sections of the sheet processing apparatus.

In FIG. 2, numeral 330*a* indicates a delivery upper roller, and numeral 330*b* indicates a delivery lower roller. Numeral M is a jogger motor as a drive source; numeral 322 indicates a paddle; numeral 323 is a reference wall for hitting the sheet rear end. As shown in FIG. 2, the delivery roller paid 303 structured of the delivery upper roller 330*a* and the delivery lower roller 330*b* is disposed upwardly on a downstream side of the flapper 150 described above in the sheet conveyance direction and driven to rotate by a drive motor, not shown.

The delivery upper roller 330*a* is supported at the axis thereof to an arm 331 pivotally movable around a paddle shaft 350 as a center. The jogger motor M is for driving respective sliding guides 301, 302 described below, and in this embodiment, a stepping motor is used.

The paddle 322 is made of an elastic material such as a rubber or the like, and plural paddles 322 are secured to the paddle shaft 350 in a direction perpendicular to the sheet conveyance direction. The sheets S are moved to a direction in opposition to the sheet conveyance direction by driving and rotating the paddle shaft 350 in a clockwise direction, and the end face of the sheets S comes in contact with the reference wall 323 to align the sheets S.

As shown in FIG. 3, with the sheet processing apparatus 300 in this embodiment, the sliding guide 301 and the sliding guide 302 are formed as described below in detail as a guide member for aligning the sheets in the sheet width direction.

In the sheet processing apparatus 300, when stapling is performed based on a command already outputted from the computer or the like, the flapper 150 moves pivotally in the counterclockwise direction in FIG. 2(*a*) by a link, not shown, from a solenoid, not shown, before the sheet S to be stapled is delivered by the delivery roller 130, and the sheet path is switched to the sheet processing apparatus 300 where the flapper 150 stops as it comes in contact with the stopper at the position shown in FIG. 2(*a*). The sheet S is thus loaded to an inlet sensor 390 of the sheet processing apparatus 300 by a roller pair formed at the printer body 100.

The sheet S loaded in the sheet processing apparatus 300 rotates a flag of the inlet sensor 390 in the clockwise direction, and the flag renders the beam transmit to the photosensor to make the detection. Then, the inlet roller pair 363 conveys the sheet upward.

This sheet processing apparatus 300 can deliver the sheets in a stacking manner on the stacking portion 325 of the sheet processing apparatus upon stapling the sheets and can deliver the sheets in a stacking manner on the stacking portion 325 of the sheet processing apparatus as simply facing down, as well. First, as shown in FIG. 2, the operation for delivering sheets in a stacking manner on the stacking portion 325 of the sheet processing apparatus, is described.

Figure 5A:
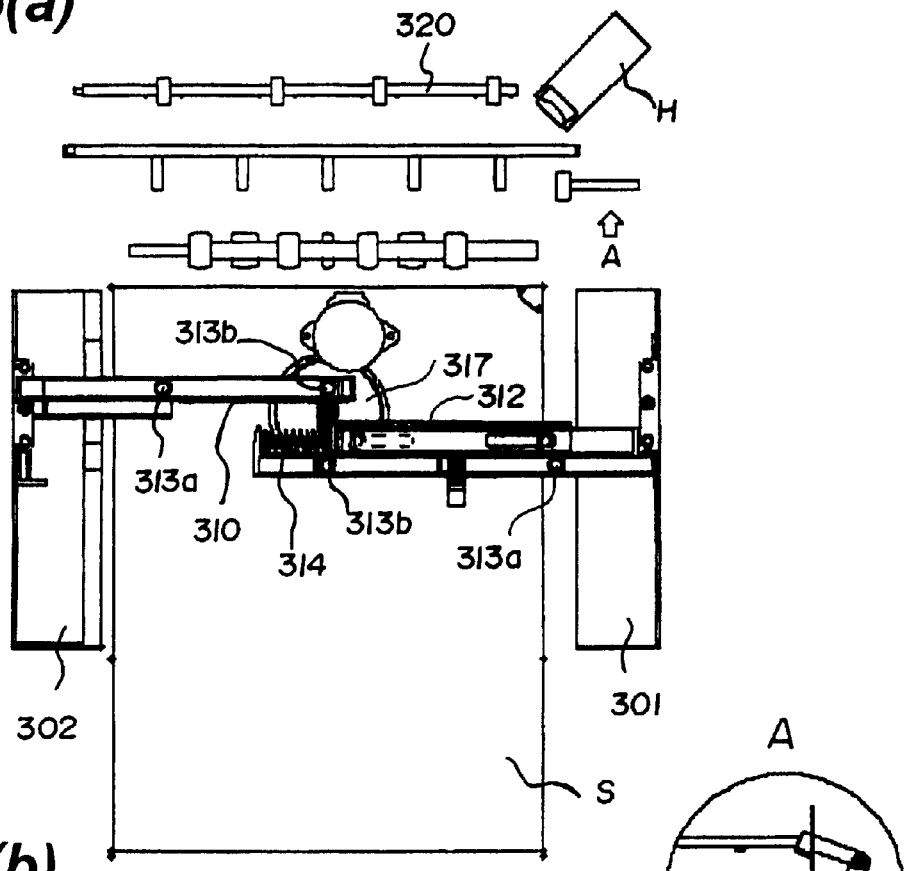
FIG. 5 collectively includes FIGS. 5(*a*) and 5(*b*), which are illustrations showing operation of the sliding guide.
Figure 5B:
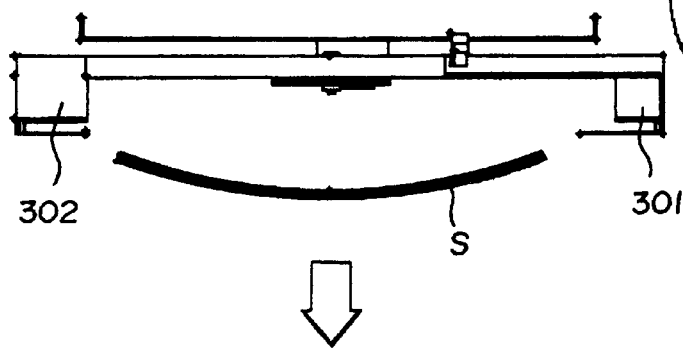

At that time, as shown in FIG. 5, the bottom surfaces of the right side sliding guide 301 and the left side sliding guide 302 with respect to the sheet loading direction, escape to a position not in contact with the sheets S to be loaded, or namely, to a position outward in the width direction by a prescribed amount from the sheet S, and therefore, the sheets S are directly conveyed to the stacking portion of the sheet processing apparatus.

The sheet conveyed from the inlet roller pair 363 is conveyed by the delivery roller pair 330 upon passing the opening of the staple H after passing through a staple roller pair 320 and stacked on a staking portion 325 of the sheet processing apparatus.

Figure 6A:
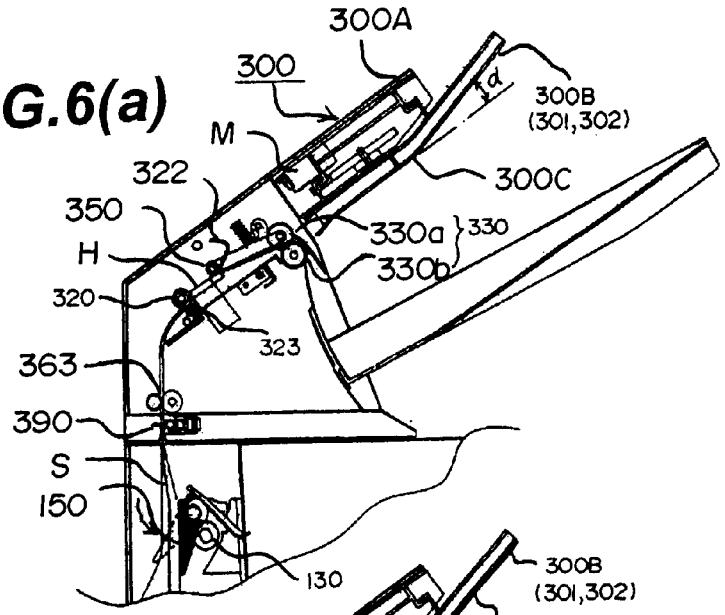
FIG. 6 collectively includes FIGS. 6(*a*), 6(*b*), and 6(*c*), which are illustrations showing a state in which sheets are aligned and stacked with the sliding guide.
Figure 6B:
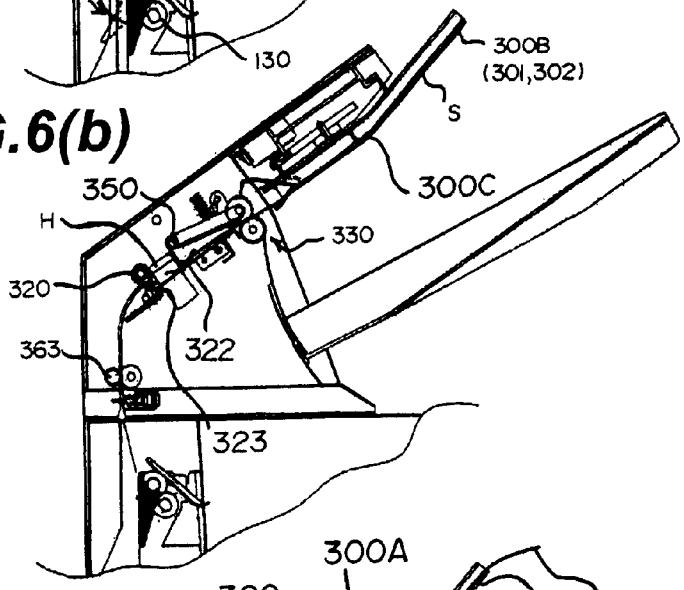
Figure 6C:
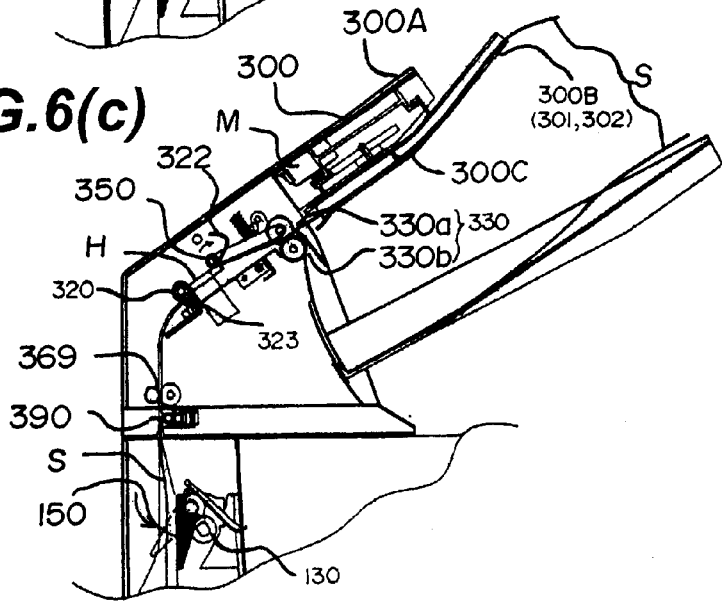
Figure 7:
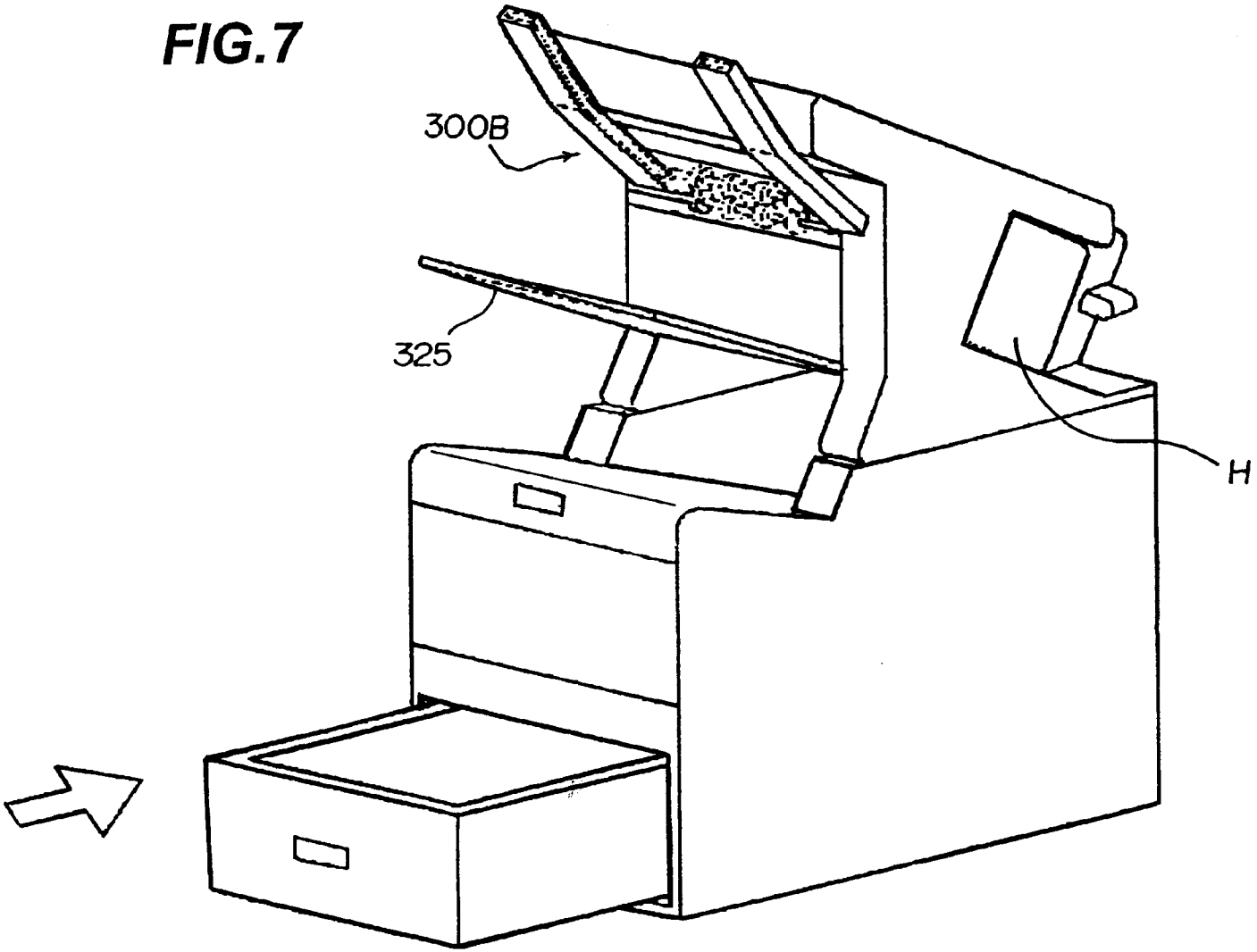
FIG. 7 is a perspective view showing a printer to which the sheet processing apparatus is mounted.

Next, referring to FIG. 6, operation to deliver the sheets in a staking manner on the stacking portion 325 of the sheet processing apparatus upon stapling is described.

At that time in the sheet processing apparatus 300, as shown in FIG. 3(*a*), a reference pin 303 and a reference pin 304 formed at the wall surfaces of the right side sliding guide 301 and the left side sliding guide 302 with respect to the sheet loading direction, escape to a position not in contact with the sheet loading direction, escape to a position not in contact with the sheets S to be loaded so as not to interfere with the sheets S to be loaded. The interval between the end of the bottom surfaces of the sliding guides is narrower than the width of the sheet, and the sliding guides wait the entry of the sheets S. This position is referred to as a waiting position.

The sheet conveyed from the inlet roller pair 363 is conveyed by the delivery roller pair 330 upon passing the opening of the staple H after passing through a staple roller pair 320 onto a guide surface of an intermediate stacking portion 300B made of the sliding guide 301 and the sliding guide 302.

The guide surface of the intermediate stacking portion 300B is slanted by a prescribed angle with respect to the horizontal direction as shown in FIG. 6(*a*), and has slanted angles different to each other between the upstream side and the downstream side in the sheet loading direction. More specifically, a bending section 300C bending with a slanted angle $\alpha$ (see FIG. 1) is formed between a prescribed section on an upstream side and a prescribed section on a downstream side. The guide surface of the intermediate stacking portion 300B prevents the sheets S not guided by the respective sliding guides 301, 302 from bending at the center, by having such a bending portion 300C.

Immediately after the first sheet is conveyed onto a surface made of the sliding guide 301 and the sliding guide 302, the arm 331 rotates in the counterclockwise direction to escape upward the delivery upper roller 330*a* rotatably supported to the arm 331, thereby isolating the delivery roller pair 330, and at the same time, cutting the drive coupled to the delivery roller pair 330 to stop the rotation of the delivery upper roller 330*a* and the delivery lower roller 330*b*. When the rear end of the sheet S passes by the staple roller pair 320 totally, the sheet returns by the self-weight in a direction opposition to the conveyance direction and moves closer to a direction of the reference wall 323.

Subsequently, upon operation solely of the left side sliding guide 302, aligning operation in the width direction begins for respective sheets stacked on the intermediate stacking portion 300B. More specifically, the sliding guide 302 is driven by the motor M to move on the right side in FIG. 3, thereby rendering the reference pin 304 formed at the sliding guide 302 contact with the left side surface of the sheet S to push the sheet S toward the sliding guide 301.

The right side surface of the sheet S then hits the reference pin 303 formed at the sliding guide 301, and thereby alignment in the width direction of the sheets is made. It is designed that the sheets S move to a stapling position defined at a position where the sheets S contacts the reference pin 303 and are aligned. After the alignment operation, the sliding guide 302 moves to a direction expanding the width of the sheet S, and the apparatus become responsible to the subsequent conveyance of the sheet at the waiting position.

Figure 4A:
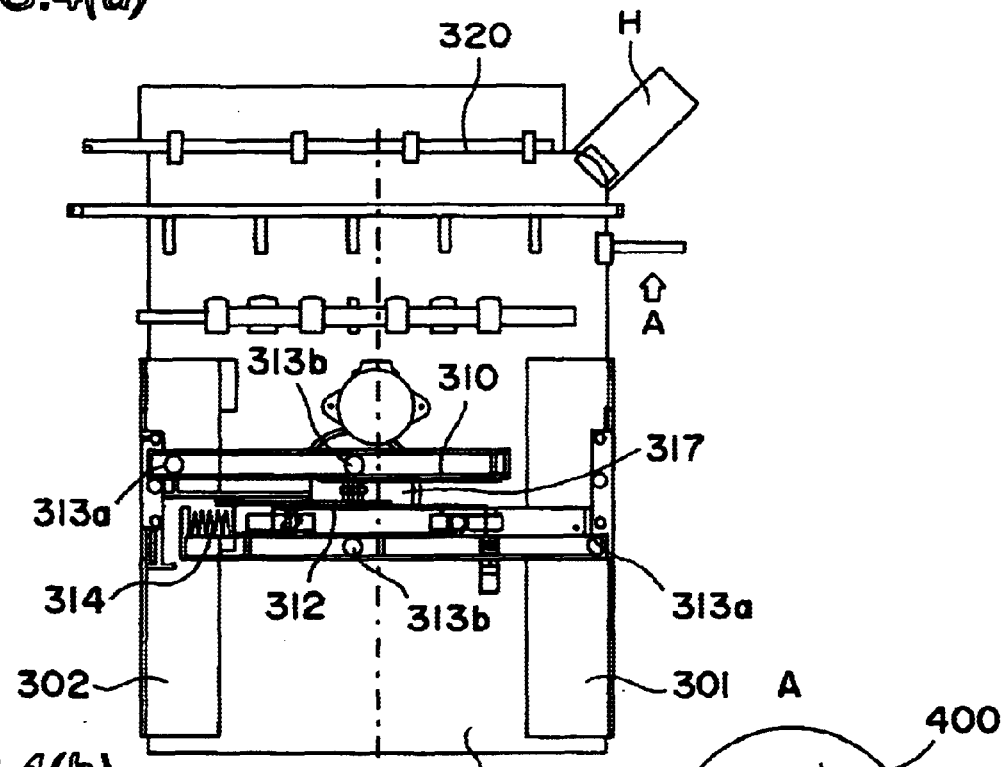
FIG. 4 collectively includes FIGS. 4(*a*) and 4(*b*), which are illustrations showing operation of a sliding guide.
Figure 4B:
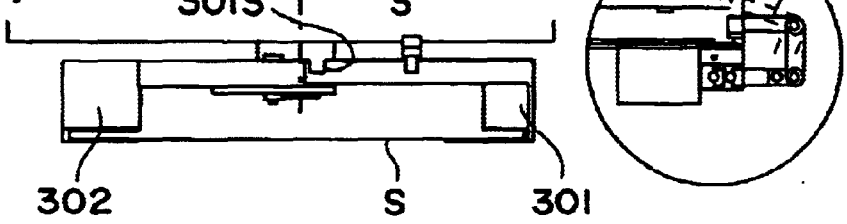

The structure of the sliding guide is now described in detail. FIGS. 3(*a*) and 3(*b*) are cross sections of the sheet processing apparatus; FIGS. 4(*a*) and 4(*b*) and FIGS. 5(*a*) and 5(*b*) are illustrations for describing operation of the sliding guide.

The respective sliding guides 301, 302 are reciprocally movable in a right and left direction in FIGS. 3(*a*) and 3(*b*), or a direction perpendicular to the sheet conveyance direction by being guided with the guide pins 313*a* formed at the molded frame and the guide pins 313*b* formed at the metal plate frame, four in total, and move according to transmission of the drive force of the jogger motor M.

The sliding guides 301, 302 are in a cross-sectionally rectangular U-shape as shown in FIG. 3(*b*) when seen from the downstream side of the sheet conveyance direction, by respective walls for guiding each edge of the sheet S and a supporting portion for supporting the up and down sides of the sheet S. The sliding guides 301, 302 has a structure to support the respective sheets delivered onto the intermediate stacking portion 300B by the lower surface of the rectangular U-shape and not to guide the center in the width direction of the sheet.

A sliding rack portion 310 having a planer gear meshing a stepwise gear 317 is formed at the sliding guide 302. In a meantime, a sliding rack portion 312 having a planer gear meshing a stepwise gear 317 is formed at the sliding guide 301. The sliding rack portion 312 is formed so as to be movable correlatively to the sliding guide 301 via a coil spring 314. The spring 314 has an end in contact with the sliding guide 301 and the other end in contact with the sliding guide 312 and is urging the sliding guide 301 and the sliding rack 312 in an expanding direction. The sliding rack 312 has a rectangular hole 312*a* for moving an embossing portion 310*a* on a side of the sliding guide 301.

The two reference pins 303 made of a metal excellent in resisting wear are formed on a side wall of the sliding guide 301, and the two reference pins 304 are formed on a side wall of the sliding guide 302. When sheets are aligned, the sliding guide 302 moves as described below to contact the reference pin 304 and the reference pin 303 with respective edges of the sheet. The sliding guide 301 and the sliding guide 302 are supported in the height direction by the stepwise gear 317 and the jog metal plate frame. The stapler H is stationally disposed on a side of the sliding guide 301 to staple the respective sheets at the left upper corner of the image side of the image-formed sheets.

Referring to FIG. 3 to FIG. 5, operation of the sliding guides 301, 302 is described. When the sheet processing apparatus 300 is turned on, the stapling roller 320 driven by the drive motor begins rotating, and then, as the jogger motor M rotates to rotate the stepwise gear 317, the sliding rack 310 of the sliding guide 302 is driven to escape outwardly. With the sliding guide 301, when the jogger motor M rotates to rotate the stepwise gear 317, the sliding rack 312 correlatively moves, and after the rectangular hole 312*a* of the sliding rack 312 contacts to the end on a right side in FIG. 3 of the embossing portion 310*a* of the sliding guide 301, the sliding guide 301 is pushed by the rectangular hole 312*a* and escapes outwardly.

A slit portion 301S is formed at the sliding guide 301. When the slit portion 301S moves to a prescribed escaping point, the photosensor 316 passes a beam, and the jogger motor M stops at that time. This position is defined as a home position.

The two reference pins 303 made of a metal excellent in resisting wearing are formed on a side wall of the sliding guide 301, and the two reference pins 304 are formed on a side wall of the sliding guide 302. When sheets are aligned, the sliding guide 302 moves as described below to contact the reference pin 304 and the reference pin 303 with respective edges of the sheet. The sliding guide 301 and the sliding guide 302 are supported in the height direction by the stepwise gear 317 and the jog metal plate frame. The stapler H is stationally disposed on a side of the sliding guide 301 to staple the respective sheets at the left upper corner of the image side of the image-formed sheets.

Referring to FIG. 3 to FIG. 5, operation of the sliding guides 301, 302 is described. When the sheet processing apparatus 300 is turned on, the stapling roller pair 320 driven by the drive motor begins rotating, and then, as the jogger motor M rotates to rotate the stepwise gear 317, the sliding rack 310 of the sliding guide 302 is driven to escape outwardly. With the sliding guide 301, when the jogger motor M rotates to rotate the stepwise gear 317, the sliding rack 312 correlatively moves, and after the rectangular hole 312*a* of the sliding rack 312 contacts to the end on a right side in FIG. 3 of the embossing portion 301*a* of the sliding guide 301, the sliding guide 301 is pushed by the rectangular hole 312*a* and escapes outwardly.

A slit portion 301S is formed at the sliding guide 301. When the slit portion 301S moves to a prescribed escaping point, the photosensor 316 passes a beam, and the jogger motor M stops at that time. This position is defined as a home position.

When a signal for entering the sheet S to the sheet processing apparatus 300 is inputted from the printer body 100 to the sheet processing apparatus 300, the jogger motor M rotates, and the sliding guide 301 and the sliding guide 302 move inside and stop at positions wider by a prescribed amount than the width of the entering sheet S. The sliding guide 301 at that position enters in a state not movable further inward whereas the stopper 301*b* contacts with the end face 313*c* of the guide pin 313*a*. This position shown in FIGS. 3(*a*), 3(*b*), is defined as a waiting position, and this waiting position becomes a reference position when the side surface of the sliding guide 301 is performing for alignment.

In this embodiment, when the side (or width) of the sheet S is the largest size that is able to make passage, the waiting position of the sliding guide 301 and the sliding guide 302 is set to have a space on each end in the width direction to become a prescribed amount d on each end.

It is to be noted that when the sheets having a width narrower than that are aligned at the sheet processing apparatus 300, the sliding guide 301 moves on a right side by a portion corresponding to this, and thereby the space on the left side in FIG. 3 at the waiting position always becomes a prescribed amount d. Meanwhile, in this situation, the space between the sheet and the sliding guide 302 becomes wider than the prescribed amount d by a half of the narrowed width.

As shown in FIGS. 4(*a*) and 4(*b*), after alignment is made in the lateral direction by the sliding guides 301, 302, both of the sliding guides escape a little outwardly, thereby rendering the regulation in the lateral aligning direction of the sheets in a rough state, and thereby rendering the sheets S movable in the sheet conveyance direction. Subsequently, as shown in FIG. 6(*b*), the paddle 322 rotates one time in a clockwise direction around the paddle shaft 350 as a center and comes in contact with the top surface of the sheet S, thereby aligning the sheets S by hitting the sheets S to the reference wall 323.

Those operations make possible alignments in the sheet conveyance direction and in the direction perpendicular to the sheet conveyance direction. To keep this aligned state, as shown in detail A of FIG. 4(*a*), a stamping means 400 is provided near the right end of the aligned sheets for pushing the aligned sheets by moving a lever having a frictional member in the up and down direction as shown in cross section A, and the lever pushes the top side of the sheet after the alignment operation is finished but before the subsequently entered sheet hits the aligned sheets, thereby avoiding the subsequent sheet to move the aligned sheets.

In operation for the next and following sheets, when the next and further sheets are conveyed, the delivery roller pair 330 is isolated. Therefore, when the rear end of the sheet S totally passes through the staple roller pair 320, the sheet returns by the self-weight in a direction opposite to the conveyance direction and moves toward the reference wall 323. Because the following alignment operation is exactly the same as the operation for the first sheet, a description is omitted.

Such operations are repeated, and where the laser nth sheet (Sn) of the one job is aligned, the respective reference pins 304 formed at the sliding guide 302 push the left side surface of the sheet to the respective reference pins 303 of the sliding guide 302, and stapling is made at a position of the rear end right side with a compact stapler H located on a rear end right side of the sheet bundle while the movement of the sliding guide 302 is stopped as shown in FIG. 4.

According to this structure and operation, during the alignment operation of the respective sheets, the sliding guide 301 stops and does not move at the reference position, and the sliding guide 302 solely moves to align the left side end of the respective sheets at the reference position, so that the stapling processing is accurately, surely performed by the stapler H stationally disposed on a side of the sliding guide 301. Moreover, even where the widths of the respective sheets loaded at one job are deviated, or where the sheet size is changed from, e.g., the LTR to the A4 in the one job, since the positions of the left ends of the sheets are aligned at a point, the stapling processing with the stapler H is finished accurately and beautifully, and an excellent advantage is obtained.

In the first embodiment, when the stapling is thus ended, as shown in FIG. 6, the arm 331 rotates in the clockwise direction to move the delivery upper roller 330*a* rotatively supported to the arm 331 downward, and drive is coupled to both rollers of the delivery roller pair 330 at the same time that the delivery roller pair 330 is formed, thereby rendering the delivery upper roller 330*a* and the delivery lower roller 330*b* begin to rotate.

With this operation, the bundle of the sheets S is nipped by the delivery upper roller 330*a* and the delivery lower roller 330*b*, and conveyed onto a surface made of the sliding guide 301 and the sliding guide 302.

When the bundle of the sheets S is completely delivered from the delivery roller pair 330, the jogger motor M drives to rotate, and thereby, the sliding guide 302 moves in an isolating direction from the state shown in FIG. 4. It is to be noted that when the sliding guide 302 begins rotating, in regarding the side of the sliding guide 301, sliding rack 312 moves to the right side in FIG. 4, and the sliding guide 301 itself does not move immediately.

When the position of the sliding guide 302 passes through the waiting position shown in FIG. 3, the rectangular hole 312*a* of the sliding rack 312 comes in contact with the end surface of the embossing portion 301*a* of the sliding guide 301, and the sliding guide 301 begins moving to the right side in FIG. 3, thereby moving both of the sliding guides 301, 302.

The bundle of the sheets S already stapled is dropped down as shown in FIG. 6(*c*) when the interval of the sliding guides 301, 302 for supporting the sheets becomes around the sheet width or wider. Thus, the sheet bundle drops to the stacking portion 325 of the sheet processing apparatus and is stacked.

The above description is the structure and a series of the operations of the printer body 100 and the sheet processing apparatus 330 in the first embodiment.

Next, referring to FIG. 7 to FIG. 14, a structure of a compact stapler H placed at a rear end right side of the sheet bundle in the first embodiment of the invention is described.

Figure 8:
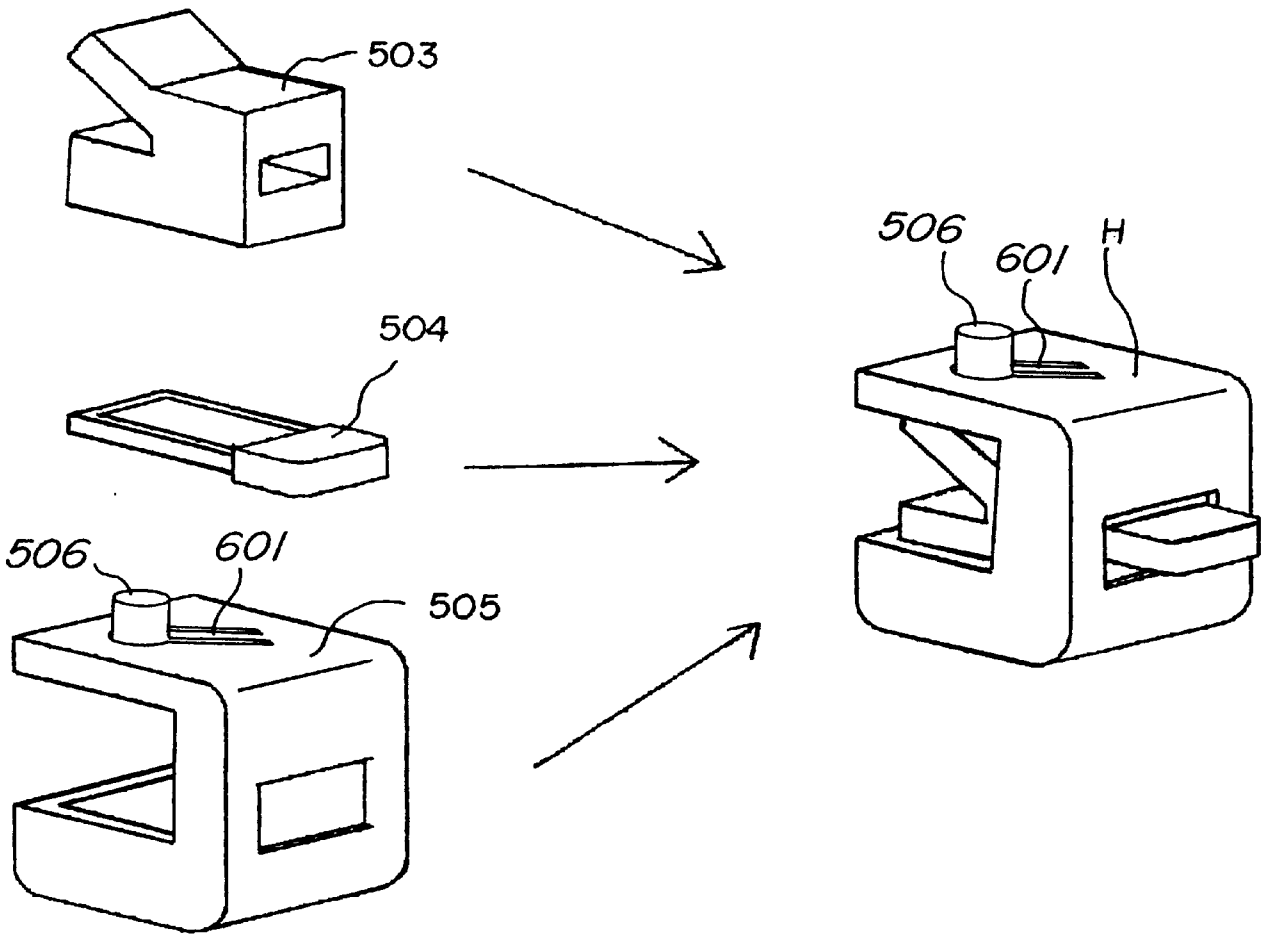
FIG. 8 is an illustration showing a structure of a staple holder.
Figure 9:
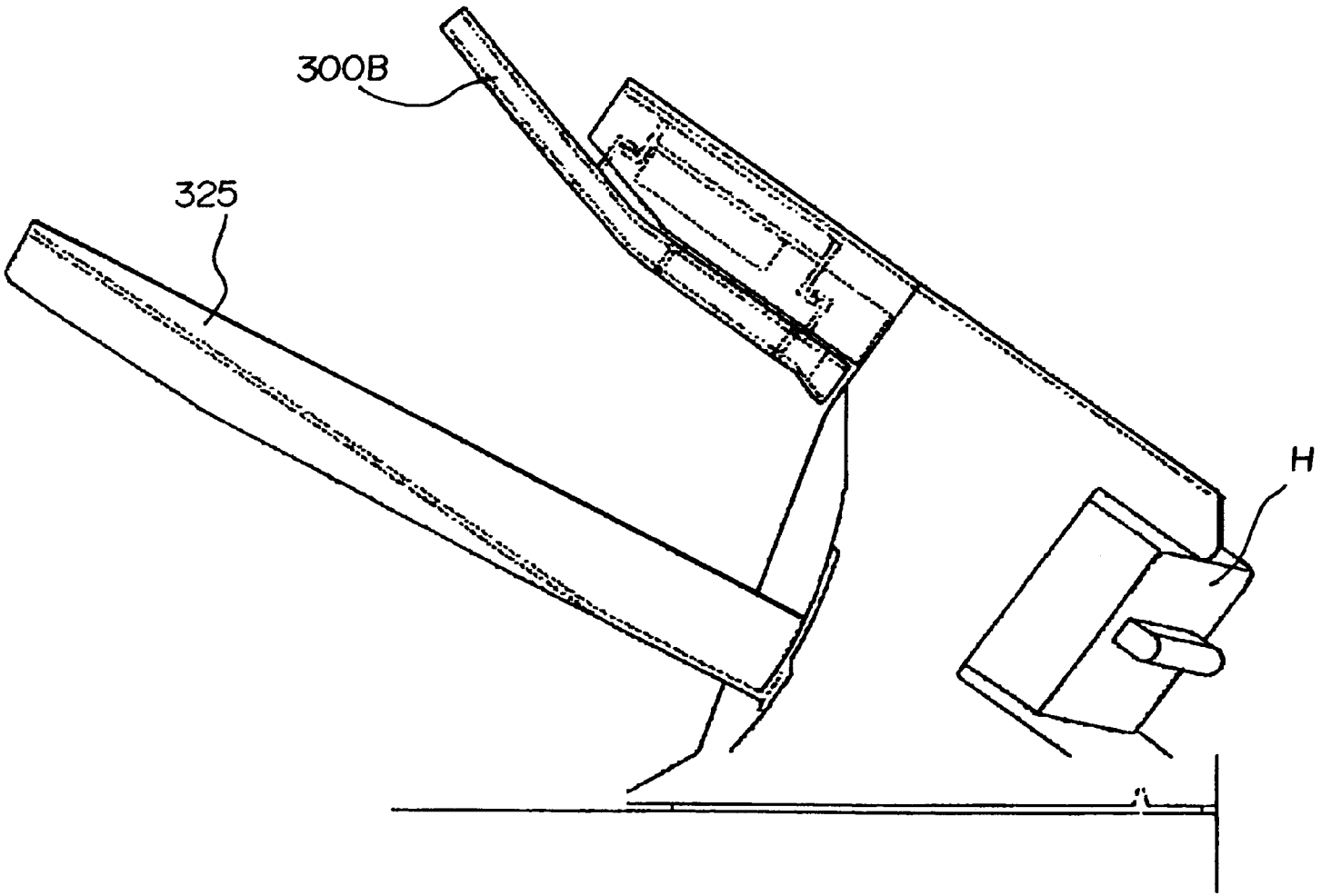
FIG. 9 is a right side view showing the sheet processing apparatus.

As shown in FIG. 8, the stapler H is structured of a stapler body 503, a staple cartridge 504, and a staple cover 505, as a staple holder H (stapling means). FIG. 9 is a right side view of the sheet processing apparatus in this embodiment. As shown in FIG. 9, the staple cover in the first embodiment also serves as an outside of a housing of the sheet processing apparatus.

Figure 10A:
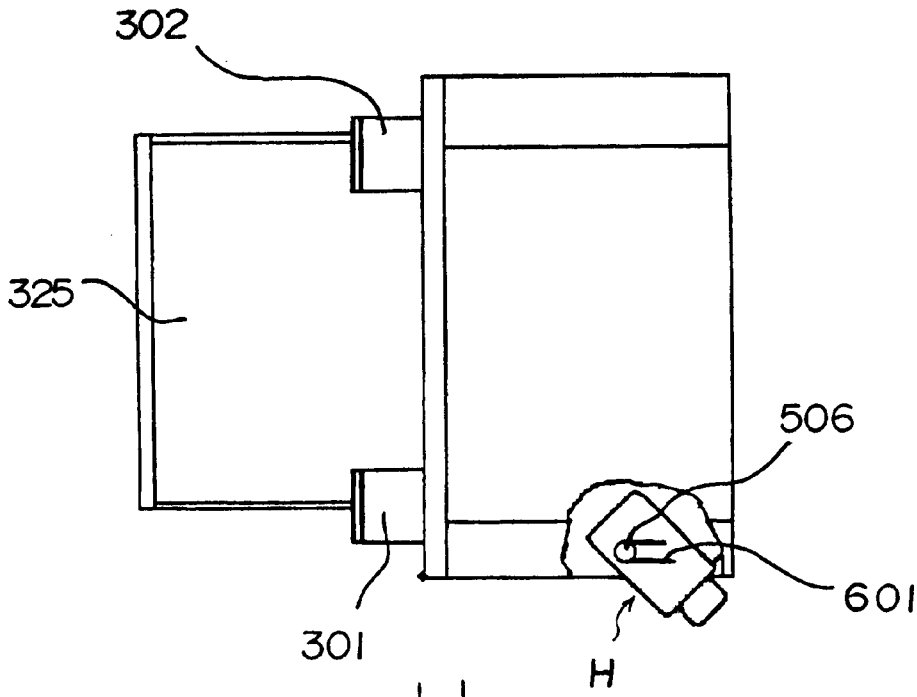
FIG. 10 collectively includes FIGS. 10(*a*) and 10(*b*), which are top views showing the sheet processing apparatus with movement of the stapler.
Figure 10B:
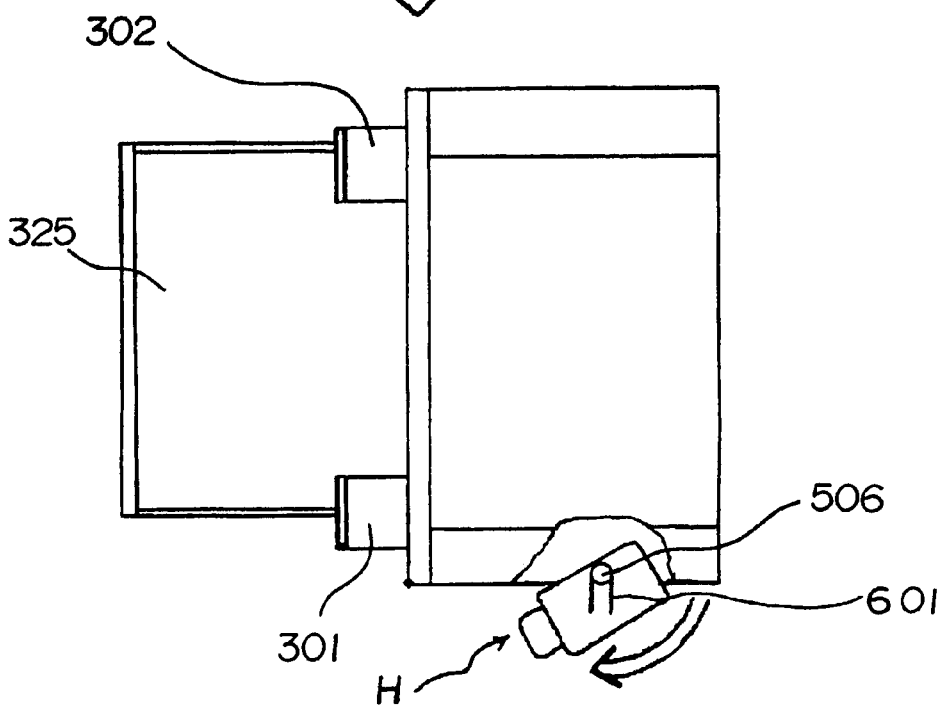
Figure 11A:
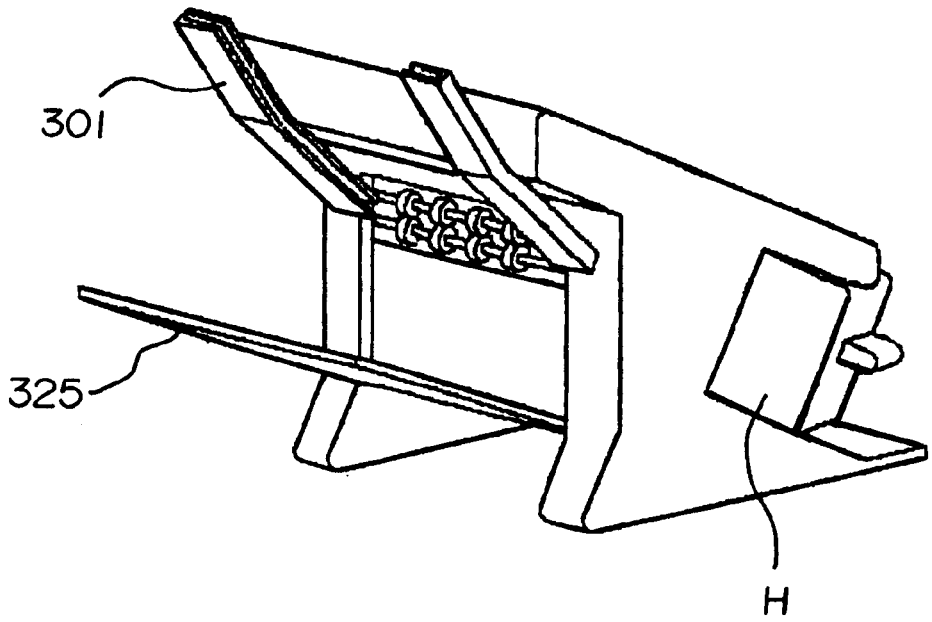
FIG. 11 collectively includes FIGS. 11(*a*) and 11(*b*), which are perspective views showing the sheet processing apparatus with movement of the stapler.
Figure 11B:
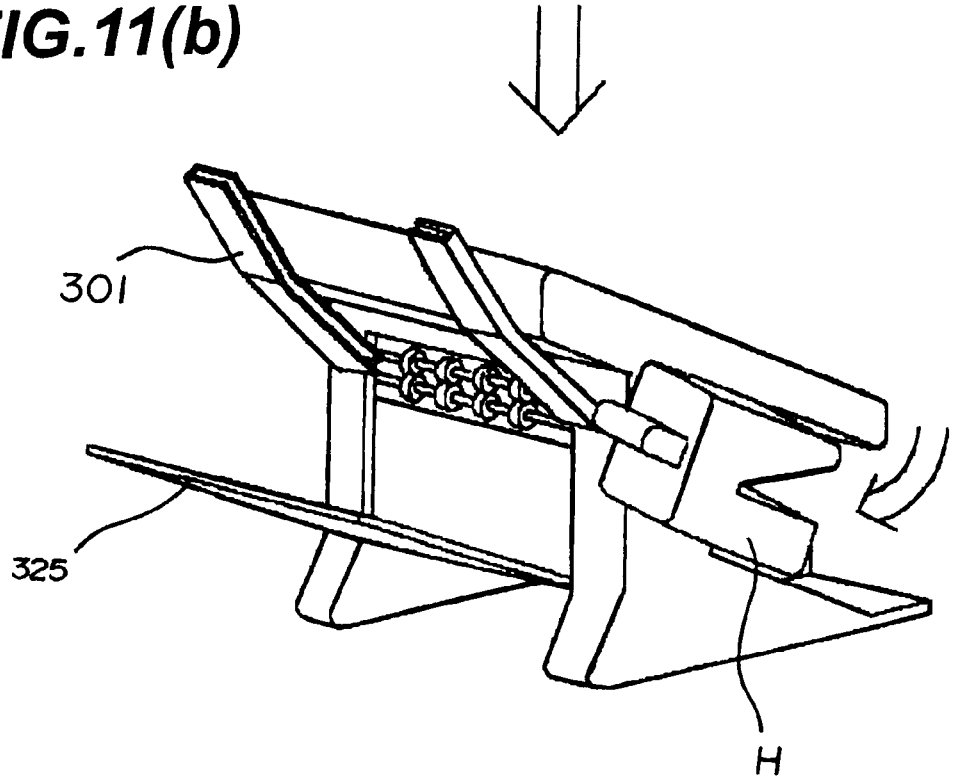

The staple holder in this embodiment is able to rotate around a shaft 506 as a center as shown in FIG. 10(*a*), FIG. 11(*a*). The staple holder is structured to hold staples with clicking feelings by a latch mechanism, not shown, at a staple operation position (see, FIG. 10(*a*) and FIG. 11(*a*), hereinafter referred to as staple operation position) and at a staple holder replacement position (see, FIG. 10(*a*) and FIG. 11(*a*), hereinafter referred to as staple holder replacement position).

Next, user's manipulation method when staples are stacked at the staple portion or when the staple portion becomes out of order, with the sheet processing apparatus of such a structure having a staple stacker function, is described.

As shown in FIG. 10 and FIG. 11, when staple stacking occurs at the staple portion or when the staple portion becomes out of order, the user directly moves the staple holder pivotally from the staple operation position to the staple replacement position around the shaft 506 as a center by hand. At that time the staple holder H is supported by a latch mechanism not shown at the staple operation position (a) with constant force, but the retaining force is released when the staple holder moves from the staple operation position (a) upon rotation by hand.

Figure 12A:
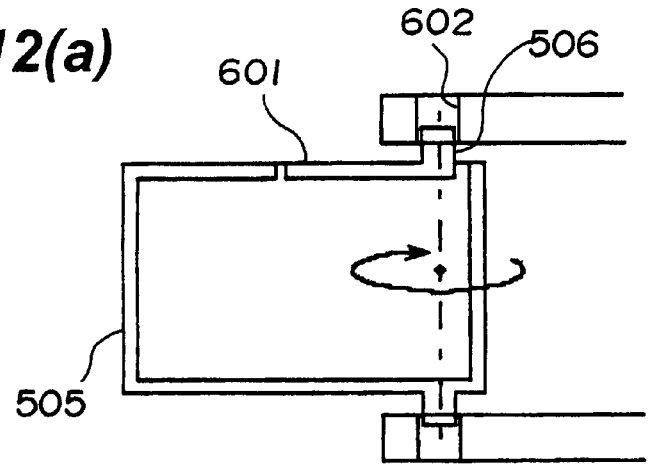
FIG. 12 collectively includes FIGS. 12(*a*), 12(*b*), and 12(*c*), which are illustrations of operation when a staple holder is removed.
Figure 12B:
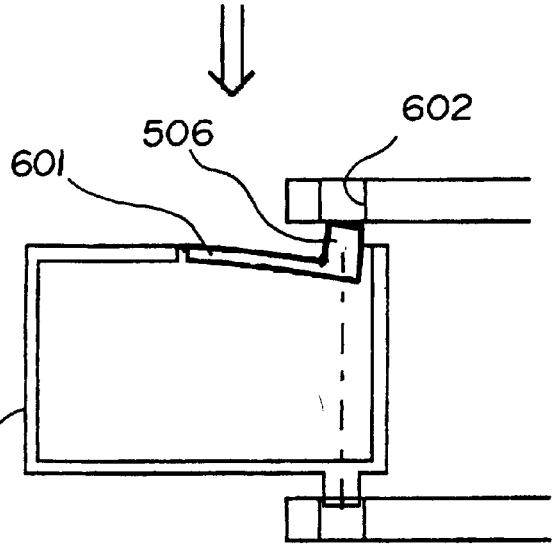
Figure 12C:
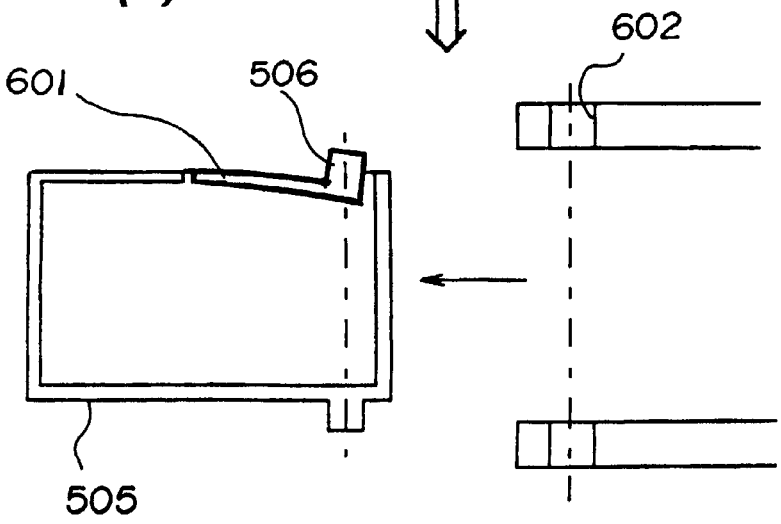

At the staple replacement position (b), as shown in FIG. 10(*b*), a projecting portion 601 including a rotary center shaft 506 located at a top of the staple holder enters in an exposed state. As shown in FIG. 12, the user can bend the projecting portion 601 by pushing a side of the projecting portion 601 from the above state and can pull out the rotary center shaft 506 from the shaft hole 602 formed in the sheet processing apparatus 300, thereby removing the staple holder H from the sheet processing apparatus. With this structure, the staple operation position (a) can improve the external appearance because the projecting portion 601 serving as the staple holding removing means is hidden.

Figure 13:
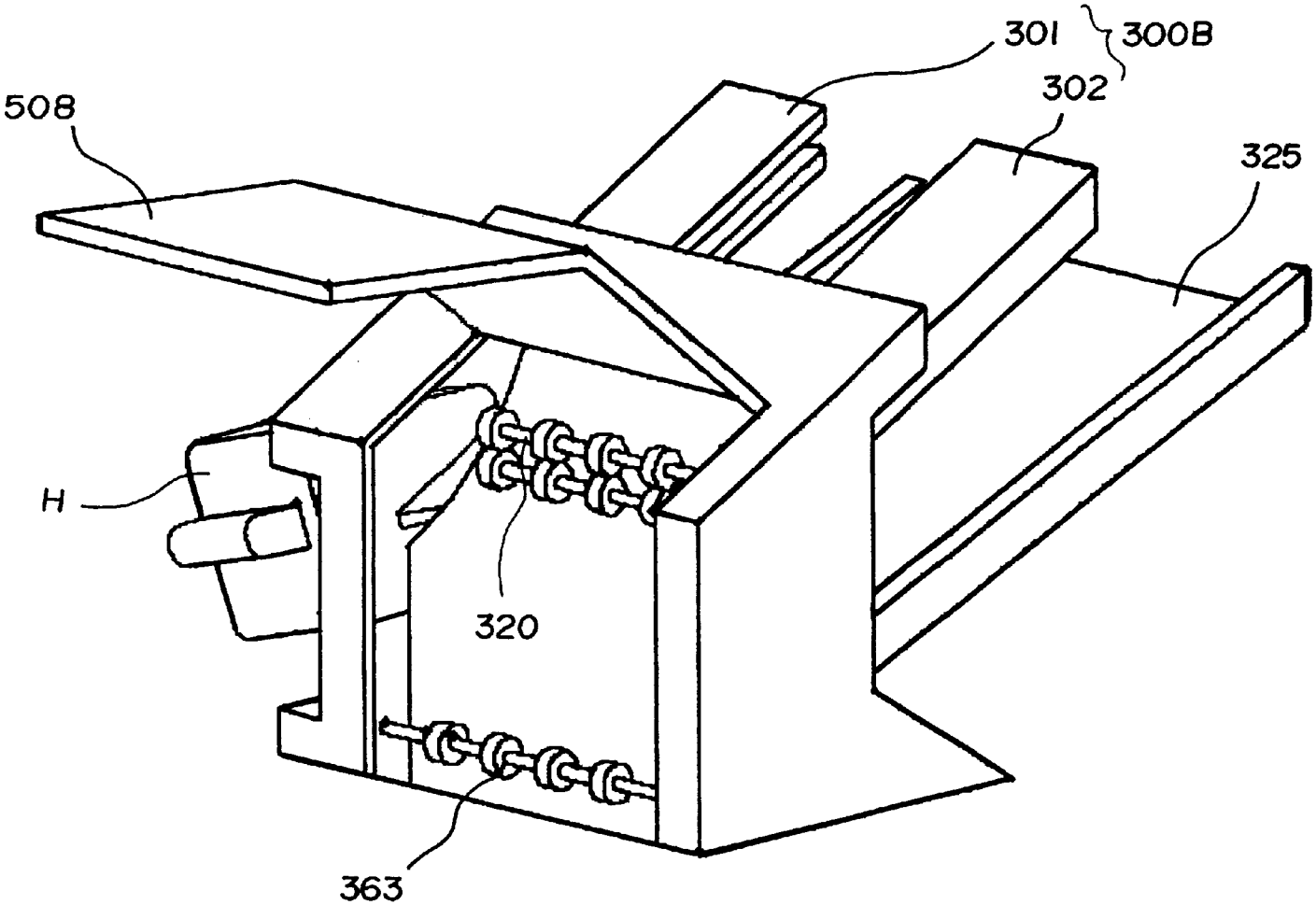
FIG. 13 is a perspective view showing the sheet postprocessing apparatus with movement of a paper jam treating housing.

The sheet processing apparatus 300 in this embodiment is formed as shown in FIG. 13 with a paper jam treating cover (paper jam treating means) 508 for handling paper jamming at the conveyance portion. With this structure, the user may be mistakenly clamped by the staple from a malfunction because the stapling section of the stapler H is not covered during a paper jam treating period. As shown in FIG. 11, also at the staple replacement position (b), the user may be mistakenly clamped by the staple from a malfunction where the stapling section of the stapler H is exposed to the exterior.

Figure 14A:
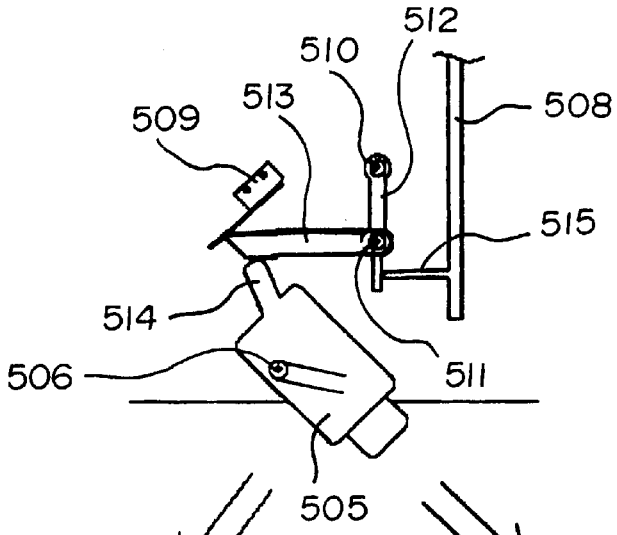
FIG. 14 collectively includes FIGS. 14(*a*) 14(*b*), and 14(*c*) which are illustrations showing a movement of operation control switch and the vicinity.
Figure 14B:
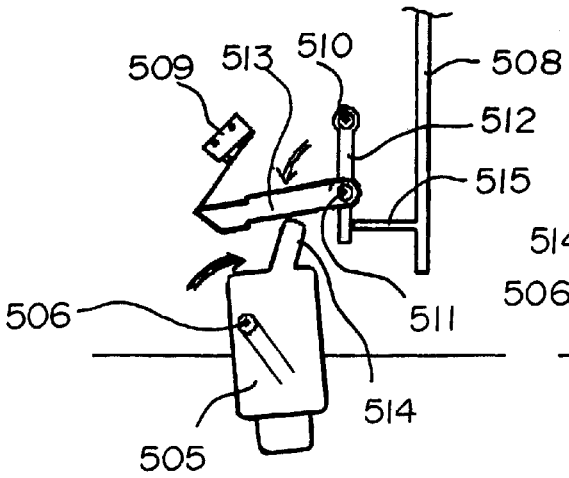
Figure 14C:
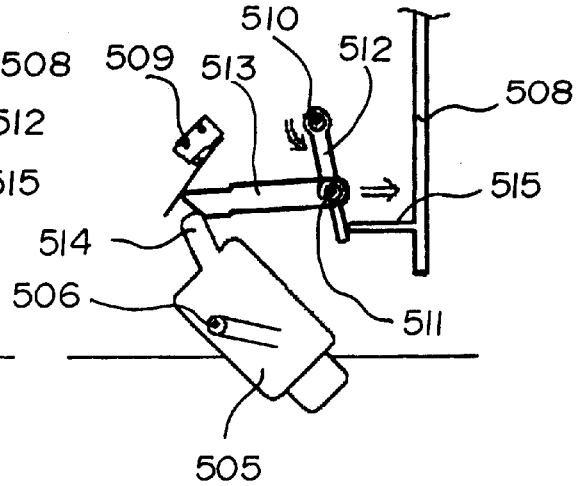

In this embodiment, as shown in FIG. 14, the apparatus is formed inside with an operation control switch 509 of the sheet processing apparatus, a link 512 for supporting a shaft 511 movable rotatably around a shaft 510, a link lever 513 pivotally movable around the shaft 511, a switch lever 514 formed at the staple cover 505, and a switch lever 515 formed at the paper jam treating cover 508.

As shown in FIG. 14(*a*), where the staple holder H is at the staple operation position (a) and where the paper jam treating cover 508 is at a closed position, the operation control switch 509 is turned on by the link lever 513 to make the sheet processing apparatus enter into an operable state.

Furthermore, as shown in FIG. 14(*b*), where the staple holder H is other than at the staple operation position (a), the operation control switch 509 is turned off because the link lever 513 pushed by the switch lever 514 of the stable cover 505 is moved pivotally, thereby making the sheet processing apparatus enter in a non-operable state. Therefore, the apparatus is designed so that, when the stapling section is exposed to the exterior at the staple replacement position (b), the user may not be clamped mistakenly with a staple by a malfunction.

As shown in FIG. 14(*c*), where the paper jam treating cover 508 is at an open position, the operation control switch 509 is turned off because the link lever 513 moves away from the operation control switch 509 by the link 512 pushed by the switch lever 515 of the paper jam treating cover 508 is moved pivotally around the shaft 512 as a center to move the shaft 511, thereby making the sheet processing apparatus enter in a non-operable state. Therefore, the apparatus is designed so that, when the stapling section of the stapler H is exposed upon opening of the paper jam treating cover 508, the user may not be clamped mistakenly with a staple by a malfunction.

Figure 15A:
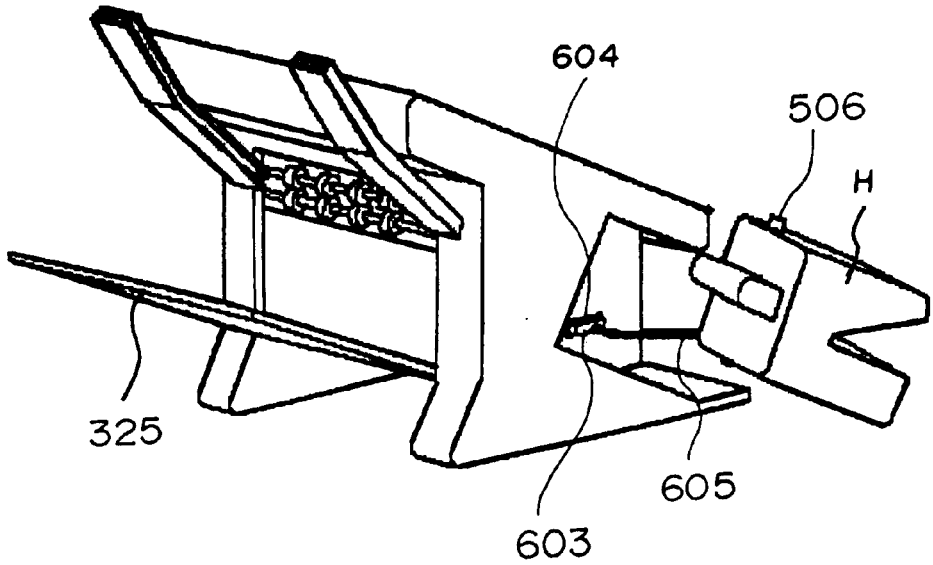
FIG. 15 collectively includes FIGS. 15(*a*) and 15(*b*), which are perspective views showing the sheet postprocessing apparatus when the staple holder is removed.
Figure 15B:
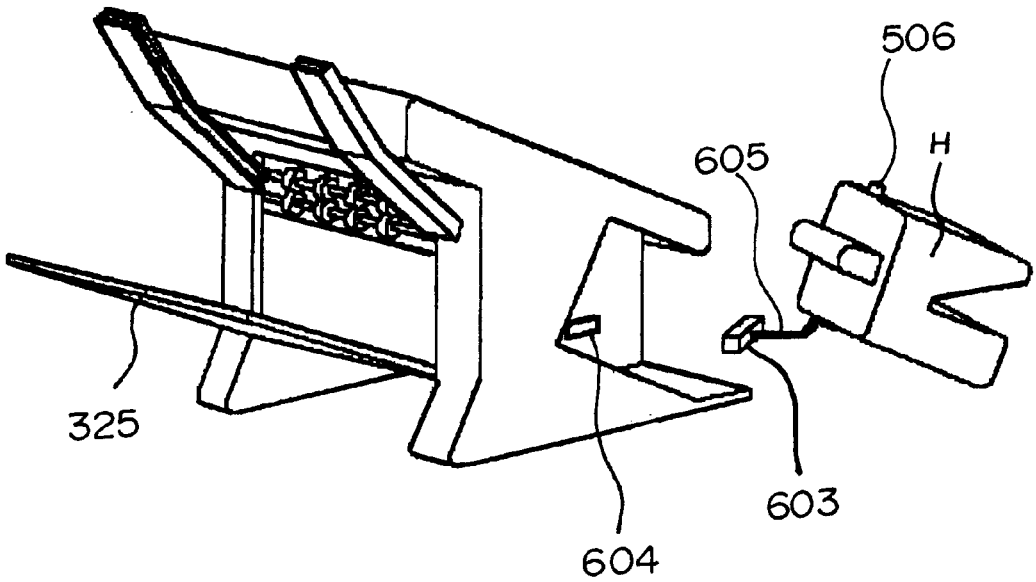

In this embodiment, the connector is necessarily taken out as shown in FIG. 15(*b*), because a cable connector (connecting portion) 603 coming out of the staple holder H and a connector 604 on a side of the sheet processing apparatus are coupled to each other at a time that the staple holder H is removed from the sheet apparatus processing as shown in FIG. 15(*a*). Similarly, when the staple holder is attached to the sheet processing apparatus, the staple holder is attached after the cable connector 603 is coupled, and the holder is returned to the staple operation position (a) upon moving pivotally from the staple replacement position (b).

With this structure, the cable 605 requires a longer length to some extent for coupling and uncoupling the connector while the holder is attached and detached. The cable 605 may be loosened to be bent during pivotal movement of the staple holder during the attachment of the staple holder, and the cable 605 may be clamped at a gap or the like between the staple holder and the sheet processing apparatus.

Figure 16:
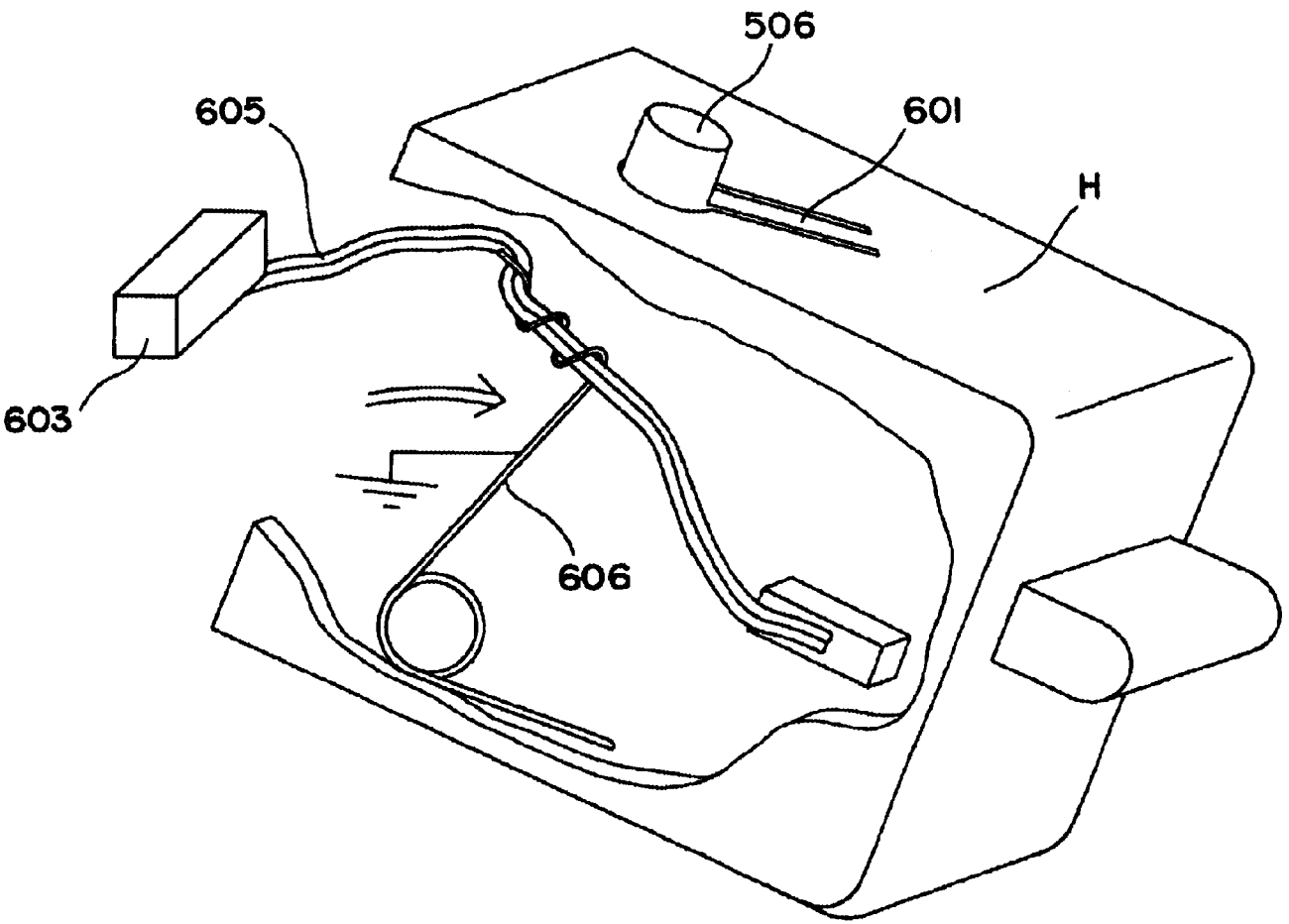
FIG. 16 is a perspective view showing a staple holder in the first embodiment.
Figure 17:
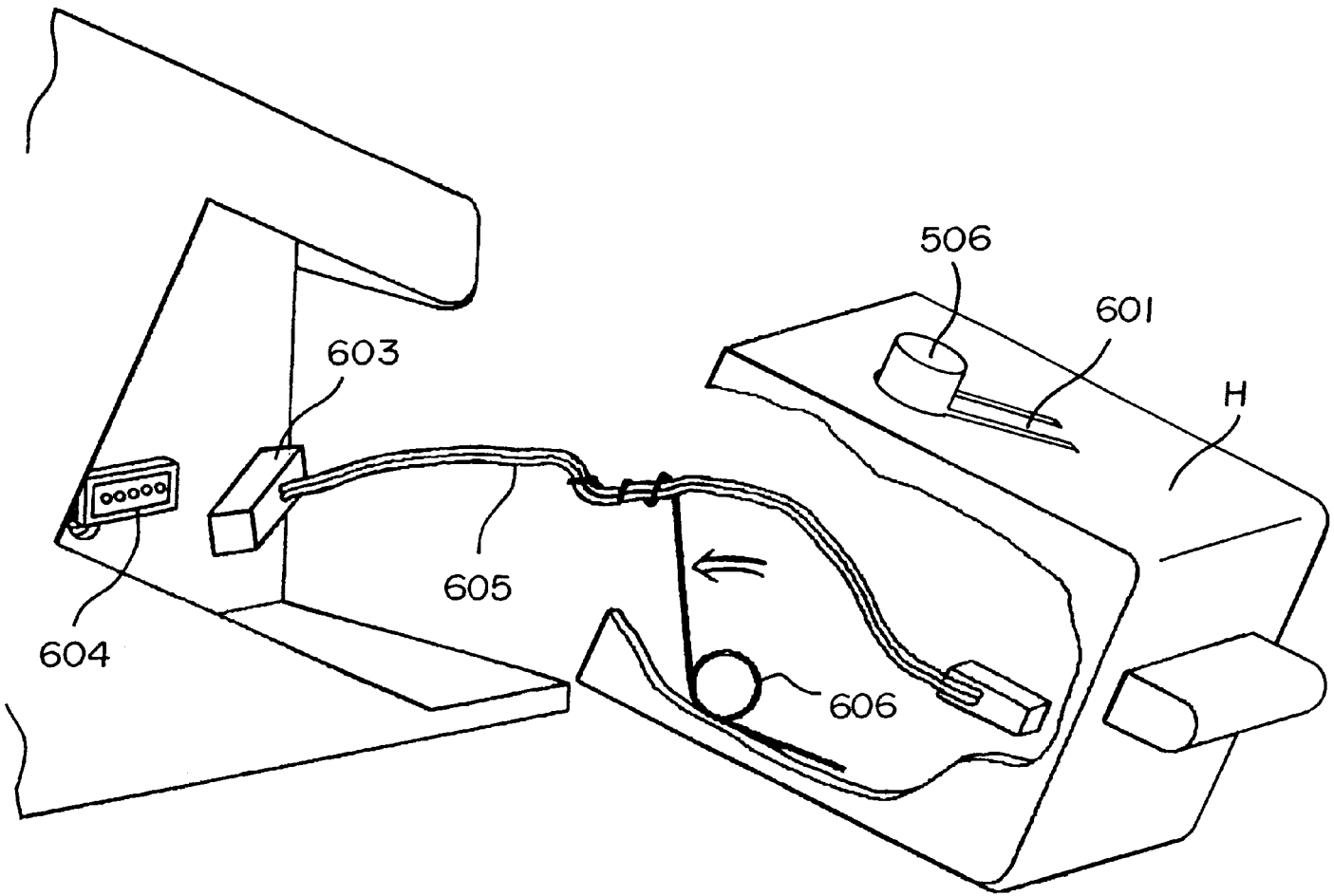
FIG. 17 is a perspective view showing the staple holder while removed in the first embodiment.

In this embodiment, as shown in FIG. 16, a wire spring 606 (urging means) is attached inside the staple holder upon securing a part of the cable 605. With this structure, while the connector is attached or detached, work is done upon pulling out of the cable 605 in opposing the urging force of the wire spring 606 by pulling the connector 603 as shown in FIG. 17. The shaft 506 of the staple holder is then fitted into the shaft hole 602 (see, FIG. 12) of the sheet processing apparatus 300 as described above and is moved pivotally to allow the staple holder H to be attached. Where the staple holder H is brought close to the sheet processing apparatus 300, the cable 605 is pulled in the staple holder H by urging force of the wire spring 606, so that the cable 605 exposed as bent during pivotal movement of the staple holder H may not be clamped between the staple holder H and the sheet processing apparatus 300.

It is to be noted that the wire spring 606 can be of a structure contacting an end of the wire spring 606 with the metal portion of the sheet processing apparatus when the staple holder H is attached to the sheet processing apparatus 300 where the attaching position of the wire spring 606 is selected properly. With such a structure, the wire spring 606 may function as a ground for the stapler.

In the first embodiment, the apparatus thus constituted can make the staple holder H separate from the sheet processing apparatus with a simpler and less expensive structure than conventional apparatuses, so that controllability such as loading work and arrangement work of staples can be improved, and so that safety in work can be realized readily. Where the wire spring 606 is used as the urging means for the cable 605, clamping the cable 605 is avoided at a gap between the staple holder H and the sheet processing apparatus 300, which otherwise occurs due to a loosen cable 605 when the staple holder H is attached and moved pivotally, so that the connector is easily attached and detached.

The Second Embodiment

Next, a compact stapler H located on a rear end right side of the sheet bundle in the second embodiment of a sheet stacking apparatus according to this invention is described. Some description is omitted by assigning the same reference numbers to the same portions whose descriptions are repetitive of the first embodiment.

As described above, the connector 604 is necessarily disengaged because the cable connector 603 coming out of the side of the staple holder H and the connector 604 on a side of the sheet processing apparatus at a time when the staple holder H is removed from the sheet processing apparatus. Similarly, when the staple holder is attached to the sheet processing apparatus, the staple holder is attached after the cable connector 603 is coupled, and the staple holder is moved pivotally from the staple replacement position (b) and returned to the staple operation position (a).

With this structure, the cable 605 requires a longer length to some extent for coupling and uncoupling the connector 603 before or after work for attaching or detaching the staple holder. The cable 605 may be loosened to be bent during pivotal movement of the staple holder H1 when the staple holder H is attached to the sheet processing apparatus after the attachment of the cable connector 603, and the cable 605 may be clamped between the staple holder and the sheet processing apparatus.

Figure 18:
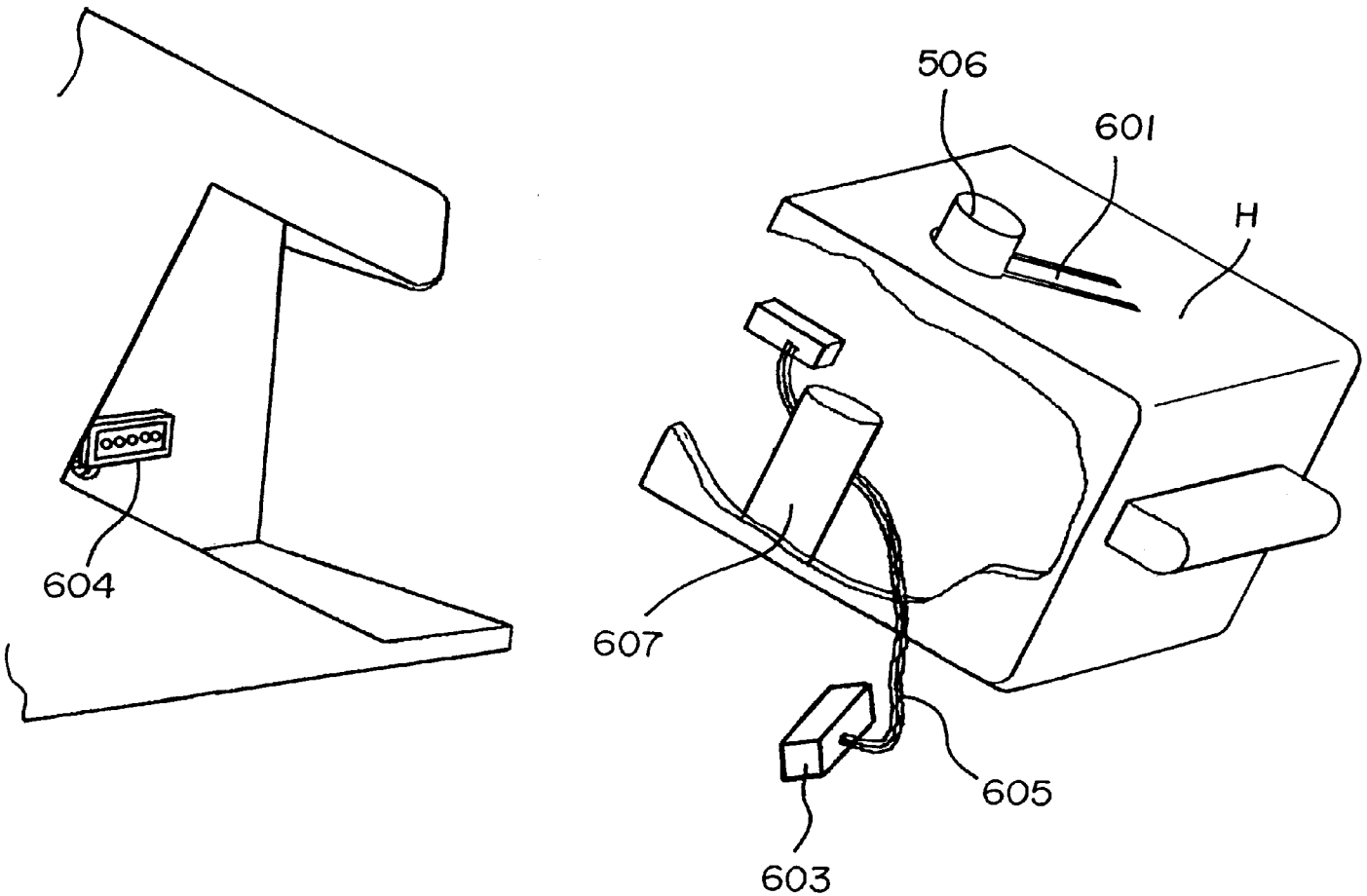
FIG. 18 is a perspective view showing the staple holder while removed in the second embodiment.
Figure 19:
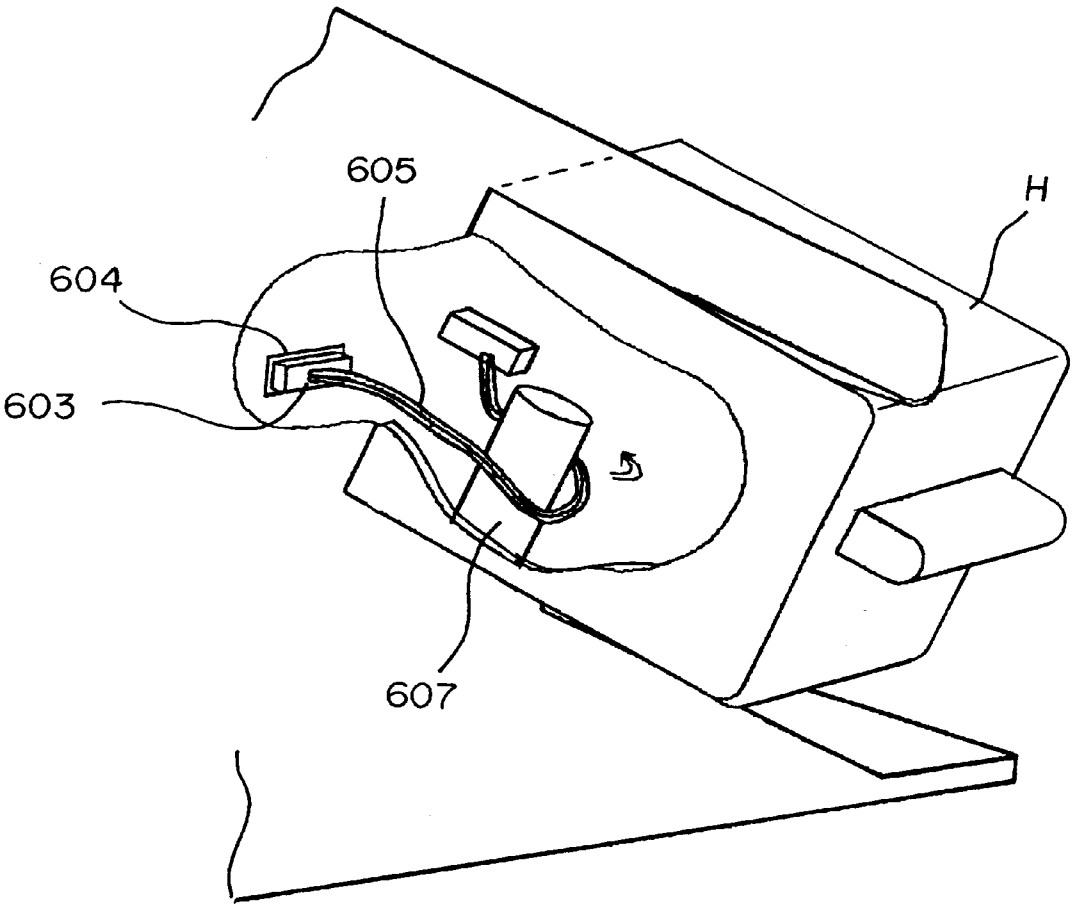
FIG. 19 is a perspective view showing the staple holder at the operation position in the second embodiment.

As shown in FIG. 18 and FIG. 19, in this embodiment, a bobbin (winding shaft) 607 for winding the cable is provided inside the staple holder for the cable 605. As shown in FIG. 18, while the connector is attached or detached, the cable 605 is unwound from the bobbin 607, and the loosen cable 605 is pulled out to make the connector attached or detached. As shown in FIG. 19, where the staple holder H is attached to the sheet processing apparatus 300 and moved rotatively, the cable 605 is wound around the bobbin 607 as the staple holder H rotates, thereby preventing the cable from being loosen to be exposed to the exterior. It is to be noted that a winding amount at a time of rotation can be increased as the bobbin 607 is placed away from the rotation center of the rotational shaft 506 of the staple holder H.

With this structure, in the second embodiment, the apparatus can realize improvements of controllability at a time of replacement work of the staple holder H in accompany with loading work of the staples and malfunctions of the staple section and safety in work with a simpler and more inexpensive structure than conventional apparatuses. Occurrence of clamping the cable is avoided at a gap between the staple holder and the sheet processing apparatus, which otherwise occurs due to a loosen cable when the staple holder H is moved pivotally.

The Third Embodiment

Next, a compact stapler H located on a rear end right side of the sheet bundle in the third embodiment of a sheet stacking apparatus according to this invention is described. Some description is omitted by assigning the same reference numbers to the same portions whose descriptions are repetitive of the first embodiment.

Figure 20:
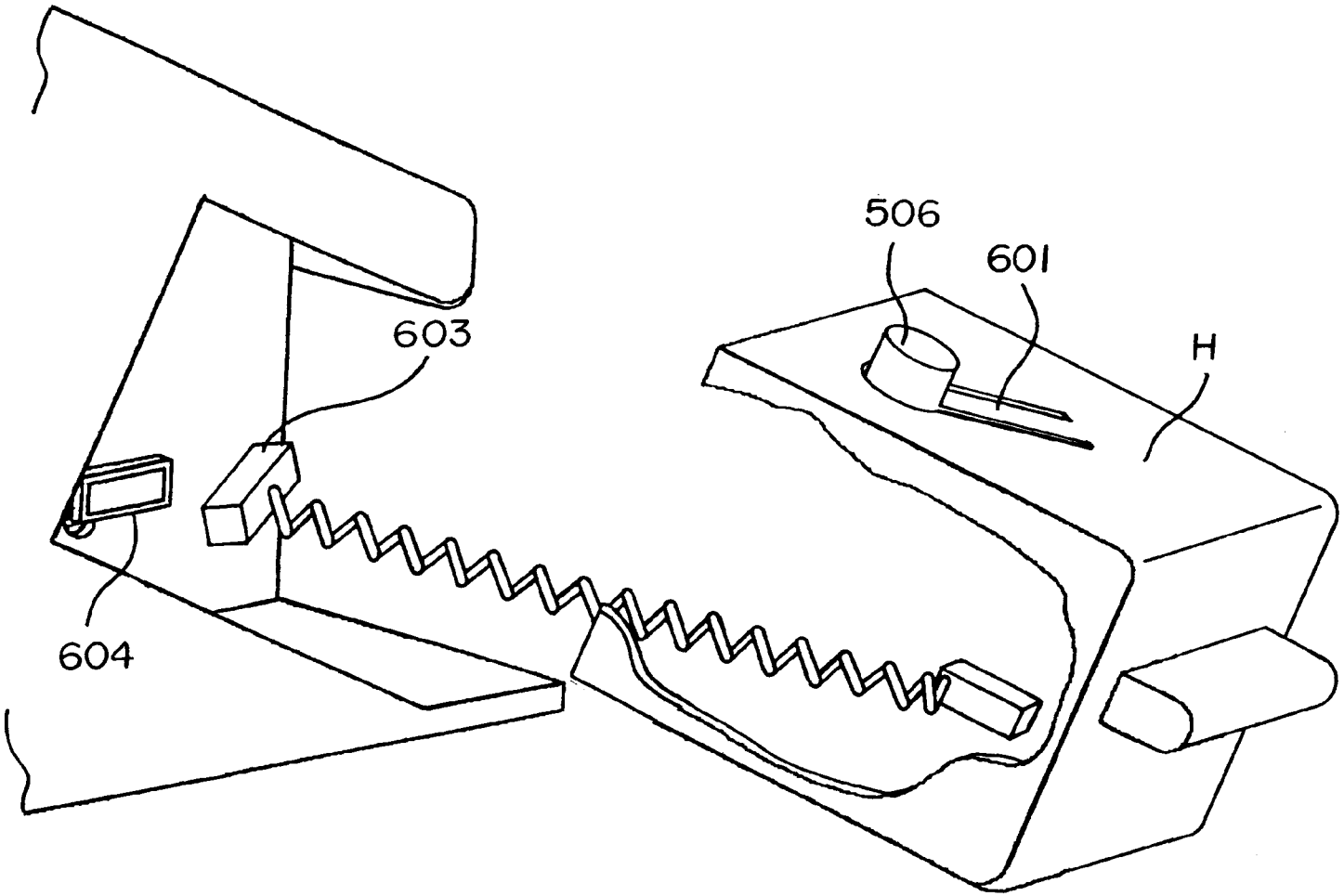
FIG. 20 is a perspective view showing the staple holder while removed in the third embodiment.
Figure 21:
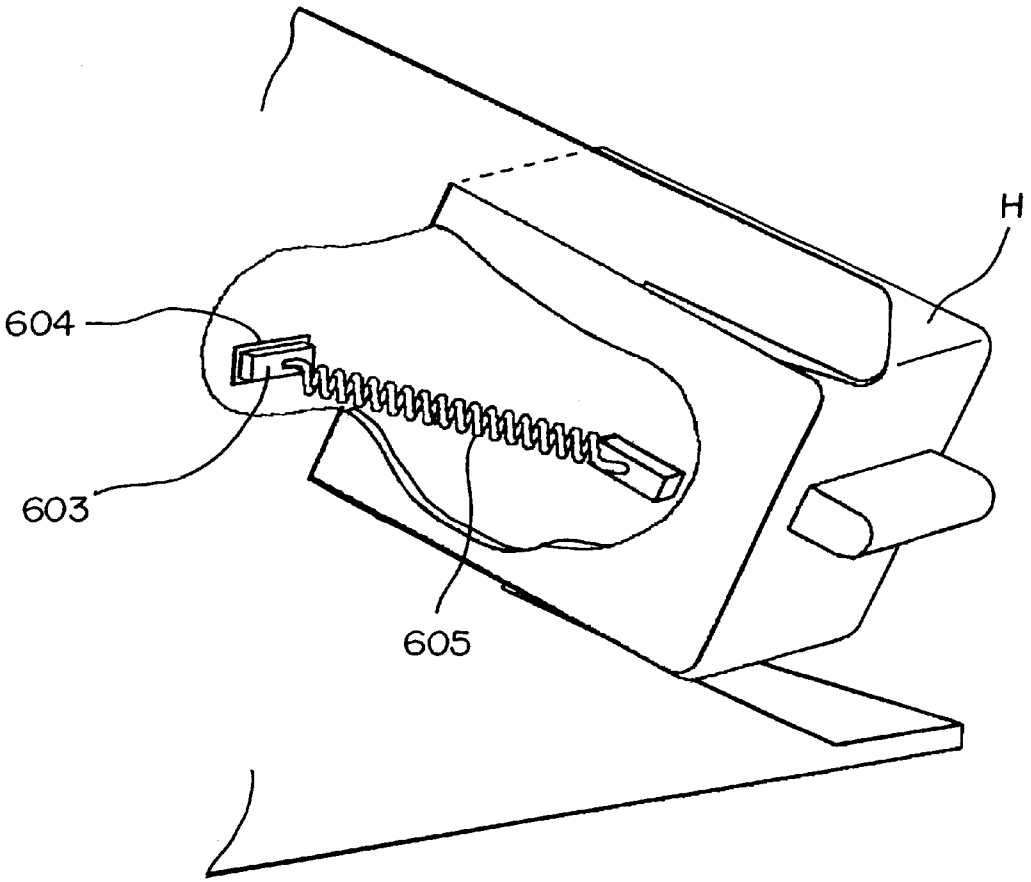
FIG. 21 is a perspective view showing the staple holder at the operation position in the third embodiment.

As shown in FIG. 20 and FIG. 21, in this embodiment, the cable 605 itself is structured as wound in a coil shape, enabling to be extendable by pulling one end of the cable. As shown in FIG. 20, with such a structure, the cable 605 wound in a spiral shape can be unwound and pulled out by pulling the connector 603 while the connector 603 is attached or detached to the sheet processing apparatus 300, thereby allowing the connector attaching and detaching work as the whole length of the cable 605 is extended. As shown in FIG. 21, when the staple holder H is attached to the sheet processing apparatus, the cable 605 is not clamped between the staple holder and the sheet processing apparatus during the rotation of the staple holder H, because the cable 605 is wound in a spiral shape to be short and does not become loosened as the staple holder H is placed close to the sheet processing apparatus 300.

With such a structure, in the third embodiment, the apparatus can realize improvements of controllability at a time of replacement work of the staple holder H in accompany with loading work of the staples and malfunctions of the staple section and safety in work with a more inexpensive structure than conventional apparatuses. Occurrence of clamping the cable is avoided at a gap between the staple holder and the sheet processing apparatus, which otherwise occurs due to a loosen cable when the staple holder H is moved pivotally, so that the connector is attached and detached readily.

Other Embodiments

In the above embodiments, exemplified is a printer as an image forming apparatus, but the invention is not limited to this, and photocopiers and facsimile machines can be used.

What is claimed is:

1. A sheet processing apparatus having a stapling means disposed detachably for stapling conveyed sheets, the stapling means being movably supported between an operation position for stapling conveyed sheets and a replacement position for detaching the stapling means from the apparatus, the stapling means comprising:

a connection portion connected to the apparatus for receiving a control signal from the apparatus;

a cable for transmitting the control signal from the connection portion to the stapling means; and an urging means for urging the cable toward an inner side of the stapling means.

2. The sheet processing apparatus according to claim 1, wherein the urging means comprises a wire spring having elasticity.

3. The sheet processing apparatus according to claim 2, wherein the wire spring is coupled to a metal portion of the apparatus and is structured for grounding the stapling means.

4. The sheet processing apparatus according to claim 1, wherein the stapling means is exposed to an exterior of the apparatus at the replacement position.

5. The sheet processing apparatus according to claim 1, wherein the stapling means also serves as an outside of a housing of the apparatus.

6. The sheet processing apparatus according to claim 1, further comprising a paper jam treating means for removing a jamming sheet disposed adjacent to the stapling means on a sheet conveyance path at the apparatus so as to be in one of an open state and a closed state, wherein the apparatus stops its operation when any one of the stapling means is located at other than the operation position and the paper jam treating means is other than the closed state.

7. The sheet processing apparatus according to claim 1, further comprising:

an intermediate stacking portion for temporarily stacking the sheets to be conveyed; and an aligning means for aligning the sheets stacked on the intermediate stacking portion.

8. The sheet processing apparatus according to claim 1, wherein the stapling means is maintained by a predetermined amount of force at the operation position and the replacement position.

9. The sheet processing apparatus according to claim 1, wherein stapling means is movable by rotational movement between the operation position and the replacement position.

10. A sheet processing apparatus having a stapling means disposed detachably for stapling conveyed sheets, the stapling means being movably supported between an operation position for stapling conveyed sheets and a replacement position for detaching the stapling means from the apparatus, the stapling means comprising:

a connection portion connected to the apparatus for receiving a control signal from the apparatus;

a cable for transmitting the control signal from the connection portion to the stapling means; and a bobbin for winding the cable inside the stapling means, wherein the cable is unwound around the bobbin where the stapling means is located at the replacement position and is wound around the bobbin more as the stapling means moves closer to the operation position.

11. The sheet processing apparatus according to claim 10, wherein the stapling means is exposed to an exterior of the apparatus at the replacement position.

12. The sheet processing apparatus according to claim 10, wherein the stapling means also serves as an outside of a housing of the apparatus.

13. The sheet processing apparatus according to claim 10, further comprising a paper jam treating means for removing a jamming sheet disposed adjacent to the stapling means on a sheet conveyance path at the apparatus so as to be in one of an open state and a closed state, wherein the apparatus stops its operation when any one of the stapling means is located at other than the operation position and the paper jam treating means is other than the closed state.

14. The sheet processing apparatus according to claim 10, further comprising:

an intermediate stacking portion for temporarily stacking the sheets to be conveyed; and an aligning means for aligning the sheets stacked on the intermediate stacking portion.

15. The sheet processing apparatus according to claim 10, wherein the stapling means is maintained by a predetermined amount of force at the operation position and the replacement position.

16. The sheet processing apparatus according to claim 10, wherein stapling means is movable by rotational movement between the operation position and the replacement position.

17. A sheet processing apparatus having a stapling means disposed detachably for stapling conveyed sheets, the stapling means being movably supported between an operation position for stapling conveyed sheets and a replacement position for detaching the stapling means from the apparatus: the stapling means comprising:

a connection portion connected to the apparatus for receiving a control signal from the apparatus; and a cable for transmitting the control signal from the connection portion to the stapling means;

wherein the cable is wound in a spiral shape at the operation position and can be further extended linearly as the stapling means moves closer to the replacement position.

18. The sheet processing apparatus according to claim 17, wherein the stapling means is exposed to an exterior of the apparatus at the replacement position.

19. The sheet processing apparatus according to claim 17, wherein the stapling means also serves as an outside of a housing of the apparatus.

20. The sheet processing apparatus according to claim 17, further comprising a paper jam treating means for removing a jamming sheet disposed adjacent to the stapling means on a sheet conveyance path so as to be in one of an open state and a closed state at the apparatus, wherein the apparatus stops its operation when any one of the stapling means is located at other than the operation position and the paper jam treating means is other than the closed state.

21. The sheet processing apparatus according to claim 17, further comprising:

an intermediate stacking portion for temporarily stacking the sheets to be conveyed; and an aligning means for aligning the sheets stacked on the intermediate stacking portion.

22. The sheet processing apparatus according to claim 17, wherein the stapling means is maintained by a predetermined amount of force at the operation position and the replacement position.

23. The sheet processing apparatus according to claim 17, wherein stapling means is movable by rotational movement between the operation position and the replacement position.

24. An image forming apparatus comprising:

an image forming section for forming an image on a sheet; and a sheet processing apparatus for processing the sheet on which the image is formed at the image forming section, wherein the sheet processing apparatus is as set forth in any of claims 1 to 23.

* * * * *

UNITED STATES PATENT AND TRADEMARK OFFICE

CERTIFICATE OF CORRECTION

PATENT NO. : 6,735,415 B2
DATED : May 11, 2004
INVENTOR(S) : Kenichiro Isobe et al.

It is certified that error appears in the above-identified patent and that said Letters Patent is hereby corrected as shown below:

Column 1,
Line 66, “lime” should read -- wire --.

Column 3,
Line 43, “at” should be deleted; and
Line 46, “veys” should read -- vey --.

Column 4,
Line 10, “paid” should read -- pair --;
Line 46, “renders the beam transmit” should read -- sends the beam transmission --; and
Line 62, “sheet” should read -- sheets --.

Column 5,
Line 44, “opposition” should read -- opposite --; and
Line 57, “contacts” should read -- contact --.

Column 6,
Line 12, “has” should read -- have --.

Column 7,
Line 9, “to” should be deleted; and
Line 60, “direction” should read -- directions --.

Column 8,
Line 33, “rendering” should read -- initiating rotation of --;
Line 34, “330b begin to rotate.” should read -- 330b. --; and
Line 56, “becomes” should read -- occurs --.

Column 10,
Line 65, “loosen” should read -- loosened --.

Column 11,
Lines 30, 36 and 47, “loosen” should read -- loosened --; and
Line 42, “in accompany” should read -- accompanied --.

UNITED STATES PATENT AND TRADEMARK OFFICE

CERTIFICATE OF CORRECTION

PATENT NO. : 6,735,415 B2
DATED : May 11, 2004
INVENTOR(S) : Kenichiro Isobe et al.

It is certified that error appears in the above-identified patent and that said Letters Patent is hereby corrected as shown below:

Column 12,
Line 7, “in accom-” should read -- accompanied --;
Line 8, “pany” should be deleted; and
Line 13, “loosen” should read -- loosened --.

Column 14,
Line 6, “means;” should read -- means, --.

Signed and Sealed this

Seventh Day of September, 2004

JON W. DUDAS
*Director of the United States Patent and Trademark Office*